United States Patent [19]

Gaudiano et al.

[11] 3,955,522

[45] May 11, 1976

[54] METHOD AND APPARATUS FOR LAUNCHING, RETRIEVING, AND SERVICING A SUBMERSIBLE

[75] Inventors: Anthony V. Gaudiano, Metairie; Larry E. Hawks, Belle Chasse; James E. McDole, Gretna, all of La.; Joseph W. Shanahan, West Palm Beach, Fla.

[73] Assignee: Peninsular & Oriental Steam Navigation, London, England

[22] Filed: June 6, 1974

[21] Appl. No.: 477,031

[52] U.S. Cl. ..... 114/43.5 VC; 114/16 G

[51] Int. Cl.[2] ..... B63B 35/40

[58] Field of Search ..... 114/43.5, 44, 50, 51, 114/16 A, 16 R, 16 G, 210, 43 VC; 214/12, 13, 15

[56] References Cited

UNITED STATES PATENTS

| | | | |
|---|---|---|---|
| 3,373,711 | 3/1968 | Bader | 114/43.5 |
| 3,390,657 | 7/1968 | Schneider | 114/43.5 |
| 3,536,023 | 10/1970 | Toher et al. | 114/43.5 |
| 3,720,179 | 3/1973 | Cohen | 114/16 G |
| 3,785,316 | 1/1974 | Leming et al. | 114/43.5 |
| 3,795,213 | 3/1974 | Strickland | 114/16 A |
| 3,807,334 | 4/1974 | Egeberg | 114/43.5 |

*Primary Examiner*—Trygve M. Blix
*Assistant Examiner*—Stuart M. Goldstein
*Attorney, Agent, or Firm*—Arnold, White & Durkee

[57] ABSTRACT

A method and apparatus for launching, retrieving and servicing a submersible from the deck of a "mother" or tender vessel. The apparatus includes a dual pivotal frame assembly mounted upon the deck of the mother vessel and a vertically adjustable platform operable to selectively mate onto the submersible. The dual frame and platform assembly is operable to launch and retrieve a submersible within a body of water surrounding the mother vessel. A submersible handling system is mounted upon the deck of the mother vessel and is operable to controllably carry the submersible into a submersible service enclosure. A power cell service enclosure is mounted upon the deck of the mother vessel in a posture contiguous to the submersible service enclosure and is operable to withdraw spent banks of power cells from a submersible power pod and rapidly reposition a charged bank of power cells within the pod.

30 Claims, 26 Drawing Figures

10
12
14
16
18
20
22
24
26
28
30
40
42
44
46
47
48
50
52
54
56
58
60
62
64
66
68
70
72
74
76
78
90
92
94
126
128
130
200
232
248
250
412

FIG. 12
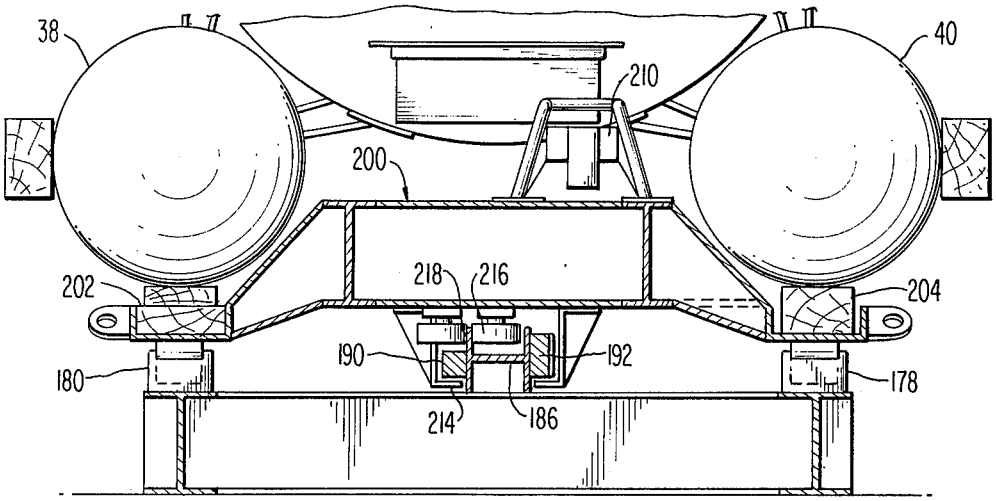
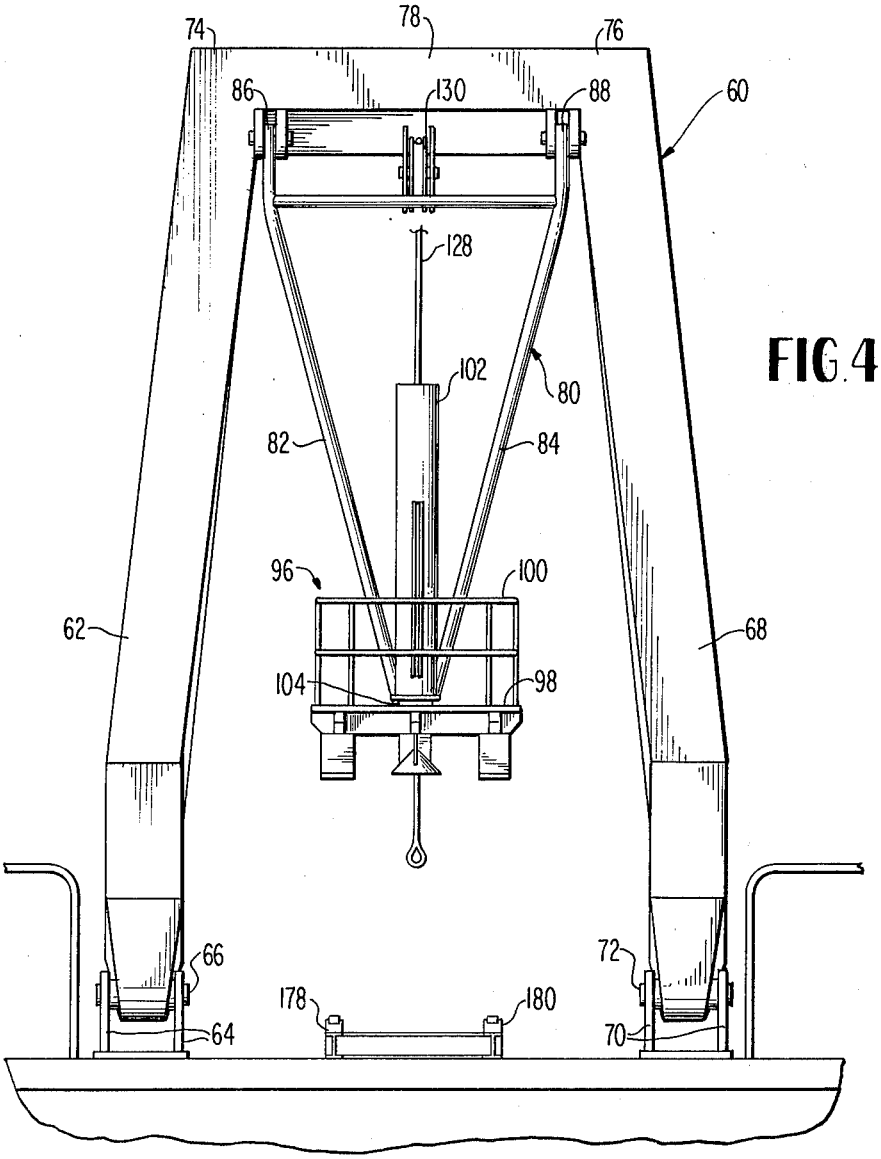
FIG. 4

METHOD AND APPARATUS FOR LAUNCHING, RETRIEVING, AND SERVICING A SUBMERSIBLE

BACKGROUND OF THE INVENTION

The present invention relates to a method and apparatus for handling a submersible. More particularly, this invention relates to a system, based on a floating mother ship, for launching, retrieving, and servicing a submersible.

The rapid depletion of a broad spectrum of raw materials and particularly a worldwide shortage of petroleum has induced exploration for these natural resources to be intensified and extended to most land areas of the earth. Formerly uncharted regions have been subjected to intense scrutiny from various land based systems, aircraft, and space vehicles. However, despite a major effort to locate and develop new sources of raw materials, the supply has continued to fall considerably short of demand. The economic consequence, of course, has been a substantial increase in the cost of raw materials.

As the price of these raw materials has increased, the exploration and exploitation of mineral resources from submerged land areas has become commercially more attractive. As an example, nodules rich in various minerals are now being mined from the floor of the ocean. Moreover, oil wells are being drilled in increasingly deep regions of continental shelves adjacent littoral states.

In most cases, once a potentially productive field is located, a well is drilled from a floating or semisubmersible vessel or a fixed platform. For examples of fixed platform structures, reference may be had to U.S. Pat. Nos. 3,585,801 and 3,668,876, to Koehler issued June 22, 1971, and June 13, 1972, respectively.

With the foregoing drilling and subsequent production activity, a problem arose in connection with an economical means for transporting the crude petroleum and gas from a drilling site to a shore collection location or an offshore transfer station. Frequently, the most economic means for accomplishing transfer has been to construct submerged pipelines between the producing and collection locations. In this connection, U.S. Pat. Nos. to Hauber et al 3,280,571 issued Oct. 25, 1966; Lawrence 3,390,532 issued July 2, 1968; Smith 3,566,609 issued Mar. 2, 1971; Nolan 3,645,105 issued Feb. 29, 1972; and Jones et al 3,668,878 issued June 13, 1972, disclose highly effective methods and apparatus for laying pipeline upon the bed of a body of water.

Shortly following the discovery that pipelines could be economically laid on a water bed significant problems were encountered such as; shifting of the line due to current, pipeline corrosion, and pipeline damage caused by anchors, fishnets and similar equipment. In order to obviate or minimize the above-noted difficulties, it has become an industry practice to bury or entrench the submerged pipeline structures beneath the water bed.

In this connection a number of burying techniques have been successfully utilized such as, for example, those disclosed in U.S. Pat. Nos. Tittle 3,338,059 issued Aug. 29, 1967; Perot 3,751,927 issued Aug. 14, 1973; and Good et al 3,786,642 issued Jan. 22, 1974.

Once the previously noted pipe laying operation is complete, economic and ecological considerations dictate a thorough inspection of the line for kinks, cracks, loss of weight coating, etc. In a similar vein, the line must again be inspected following the burying operation.

Initially, in shallow water regions, this inspection operation was performed by a diver walking along the line and visually inspecting it for defects. However, as lines extended into deeper waters it rapidly became apparent that other techniques would be required. In this connection, over the past decade or so, untethered, deep-operating, self-propelled craft, sometimes referred to as submersibles, have been effectively utilized in inspection work.

Submersibles presently inn use in typically two- or three-man crafts which are normally ferried on the deck of a mother ship to the line to be inspected. The submersible systems are powered by rechargeable direct current cells carried by the craft. Once an inspection is completed or the power cells are spent, the submersible returns to the surface and is retrieved by the mother vessel for storage and/or servicing.

Further in the above connection, submersibles are typically lowered into the water by a suitable A-frame crane or davit located on the deck of the mother ship. The position of the submersible relative to the mother ship and the A-frame crane has been previously steadied by a plurality of lead lines connected to the submersible and manipulated by deck hands operating from the deck of the mother vessel. Once the submersible was in the water, divers released the crane and lead lines and the submersible could begin a diving operation.

When inspection of the pipeline system was completed or the power cells became depleted, the submersible would return to the surface to be retrieved in a manner similar to that employed in the launching of the craft. More particularly, divers would attach lead lines and a main hoisting line to the submersible and the submersible would be hoisted from the water while deck hands again engaged in steadying the vessel. Once deposited and secured on the mother vessel, the submersible's power cells could be removed and replaced or recharged.

While the above general arrangement and procedure may have been relatively satisfactory in the past, room for significant improvement remains.

In this regard, when seas are rough, it may be dangerous to have divers in the water, particularly in the vicinity of the mother vessel and the submersible. A diver may become tangled in the lines used to hoist or steady the submersible. Furthermore, a diver could be swept by waves into contact with the screws or rudders of the mother ship.

Rouch seas may also cause problems once a submersible is suspended from an A-frame crane since it may be impossible to exert sufficient control over perpendicular or swinging movement of the submersible. The submersible may also tend to spin in a generally horizontal plane at the end of the line used to suspend the submersible from the crane. Movement of this type may render the submersible vulnerable to damage due to impacting with the crane or mother ship.

This general phenomenon of pendular and/or spinning motion of the submersible may be controllable by hand lines in quiet waters. In waters as rough as the North Sea, however, such an arrangement may be impractical since it might simply require too many men. Indeed, stabilization of the submersible by means of lead lines may not be possible with a normal crew, particularly considering the fact that footing abroad a pitching and rolling vessel may be difficult to maintain.

Further, in rough seas, a reliable, quick and safe method and apparatus must be available to connect a line to the floating submersible. If divers are employed to connect the various lines to the submersible, the operation may not only be unsafe, as previously noted, but may also be slow and/or unreliable in that opportunities to effect the connection may be missed. Similarly, if independent capture lines are used, the connection may be undesirable since it may be extremely difficult to effect a proper engagement of the capture lines by the submersible.

A further problem with the prior submersible handling arrangements and procedures resides in the manner in which the power cells which provide energy to the submersible are recharged. At least three different techniques have been previously known.

As indicated above, the power cells are commonly disposed in long cylindrical pods attached to the hull of the submersible. Once the cells are spent and the submersible has been retrieved by the mother vessel, the power cells may be recharged in place within the pods. A considerable length of time, however, may be consumed in the course of this recharging operation. To alleviate significant time gaps in a working cycle, a second submersible is required so that one submersible can be in service while the power cells of the other are being recharged. This requirement of twin submersibles obviously causes a considerable increase in the overall overhead cost of the inspection operation. It also may complicate the handling equipment on board the mother ship since two submersibles must be accommodated.

Alternatively, the pods containing the power cells may be opened, the power cells removed, and new or recharged cells installed. Due to the cramped working quarters and the nature of this task, such replacement of power cells can be a quite laborious and time-consuming process. Indeed, using this particular technique, a submersible carrying a compliment of fifty power cells may be out of operation for as long as eight hours. Thus, if only a single submersible is used, the efficiency of the entire operation is again sufficiently impaired.

A third technique entails replacing the power cells in an automated process while the submersible is submerged. This operation requires the use of a habitat or other similar submerged base. Commonly a package of fresh power cells is disposed on the exterior of the habitat or base. The submersible docks with the habitat and a ram removes the spent package of power cells and slides the fresh package into place. This technique may be subject to a number of problems. For instance, conducting the exchange of power cells in a submerged environment renders the operation vulnerable to a number of accidents, any one of which could leave the submersible crippled and the occupants trapped beneath the surface of the water. Should the ram fail after having removed the spent power cells and prior to installing the fresh power cells, the submersible would be without power and perhaps unable to surface or maneuver. Also, as indicated, this system requires the use of a habitat or other similar submerged base for the removal and replacement operation.

A further problem somewhat related to that of replacing the power cells resides in the exposure of the submersible and the workmen replacing the power cells and otherwise servicing the vessel to ambient elements. In this connection, weather on the North Sea is often highly inclement. In many of the arrangements and procedures for replacing the power cells and servicing the submersible, the vessel may be simply secured to the deck of the mother vessel. Thus, men removing the power cells and servicing the submersible may be subjected to the winds, rain, and cold characteristic of the region. This, of course, hampers the overall operation and may render the men more vulnerable to injury.

The problems suggested in the preceding are among many which may tend to reduce the effectiveness of arrangements and procedures of the prior art employed to handle and service submersibles. Other noteworthy problems may also exist; however, those presented in the discussion above should be sufficient to demonstrate that the methods and apparatus for launching, retrieving, and servicing submersibles presented in the prior art have not been altogether satisfactory.

OBJECTS AND BRIEF SUMMARY OF A PREFERRED FORM OF THE INVENTION

Objects

In light of the foregoing, it is, therefore, a general object of the invention to provide a novel method and apparatus for launching, retrieving, and servicing a submersible intended to obviate and minimize problems of the type previously described.

It is a particular object of the invention to provide a novel method and apparatus for launching and retrieving a submersible which can be based entirely on the deck of a mother ship and which therefore obviates the need for drivers to enter the water in the vicinity of the submersible and the mother ship.

It is another object of the invention to provide a novel method and apparatus for launching and retrieving a submersible in which positive control of the submersible can be exerted during the handling operation to minimize the pendular and/or spinning motion which may be induced in the submersible by the rolling and pitching motion of the mother ship in rough seas.

It is a related object of the invention to provide a novel method and apparatus for launching and retrieving a submersible wherein a rapid mate on is achieved between the submersible and a handling frame once the submersible is raised sufficiently to no longer be completely buoyantly supported within the surrounding body of water.

It is still another object of the invention to provide a novel method and apparatus for launching and retrieving a submersible in which the movement of the submersible is mechanically controlled independently of any manual manipulation of the submersible by deck hands.

It is yet another object of the invention to provide a method and apparatus for launching and retrieving a submersible which is capable of taking optimal advantage of an often fleeting opportunity to connect to the submersible the lines employed in retrieving the craft.

It is a further object of the invention to provide a novel method and apparatus for securely handling a submersible on deck of a mother vessel.

It is yet a further object of the invention to provide a novel method and apparatus for facilitating a servicing operation of a submersible on board a mother vessel.

It is still further an object of the invention to provide a novel method and apparatus for servicing a submersible in which power cells providing energy to the submersible may be quickly and easily removed and replaced so that the submersible can be rapidly returned to service.

It is still a further object of the invention to provide a novel method and apparatus for handling banks of power cells within a protective enclosure for receiving banks of spent power cells from a submersible and rapidly replacing the spent banks of power cells with charged power cells from the protective enclosure.

Brief Summary

An apparatus according to a preferred embodiment of the invention which is intended to accomplish at least some of the foregoing objects includes an assembly mounted upon a mother vessel for launching, retrieving, and servicing a submersible having at least one pod for the storage of dolly mounted power cells.

The apparatus includes a first frame member pivotally mounted upon the deck of the mother vessel in a posture such that the free end of the frame is operable to alternatively extend over the deck of the vessel or the surface of a body of water adjacent the mother craft. A second frame is pivotally connected to the free end of the first frame and is operable to support a platform which hangs in a generally plumb position as the first frame is pivoted. A power assembly is connected between the platform and the second frame for selectively vertically adjusting the platform relative to the second frame member. A flexible connector is wound upon a winch, guided over a sheave connected to the free end of the first member and finally threaded through an opening in the platform. The free end of the flexible connector is fashioned with a loop for selective connection with a submersible.

The deck of the mother vessel is fitted with a parallel set of aligned rollers and a cradle for carrying the submersible from one location to another upon the mother vessel.

A plurality of mutually parallel rails are transversely mounted across the deck of the mother vessel and serve to carry at least a first and second longitudinally extending tray which is operable to translate laterally upon the plurality of rails. A power assembly is connected to the mother vessel and is operable for selectively translating the trays along the plurality of rails to selectively align the trays with the at least one pod of the submersible. A further power assembly is connected to the mother vessel and is operable for longitudinally pulling a bank of dolly mounted power cells onto or off the first or second tray.

A method which is intended to accomplish at least some of the foregoing objects includes pivoting the first frame member outwardly over the surface of the body of water and thereby suspending a platform from the frame. A flexible connector is hooked over a catch carried by a floating submersible. The next step includes mating the platform with the floating submersible by raising the submersible out of the body of water through concurrently winding up the flexible connector on the winch and lowering the platform relative to the second frame. The method further includes pivoting the first frame carrying the submersible in a plumb position over the deck and positioning the submersible upon a cradle resting upon the parallel assembly of aligned rollers. Yet further, the method includes translating the cradle upon the parallel assembly to a service location and orienting in longitudinal alignment at least one pod carried by the submersible with at least one tray for receiving and switching dollies of power cells.

The steps of receiving and replacing include pulling a plurality of dolly carried power cells from the pod onto a longitudinally extending tray, laterally translating the tray upon the plurality of rails to a position axially offset with respect to the at least one pod, laterally translating a second tray to a position of axial alignment with the at least one pod and moving a plurality of charged power cells from the second tray into the pod for subsequent use in powering the submersible.

THE DRAWINGS

Further objects and advantages of the invention will become apparent from the following detailed description taken in conjunction with the accompanying drawings wherein.

Figure 5:
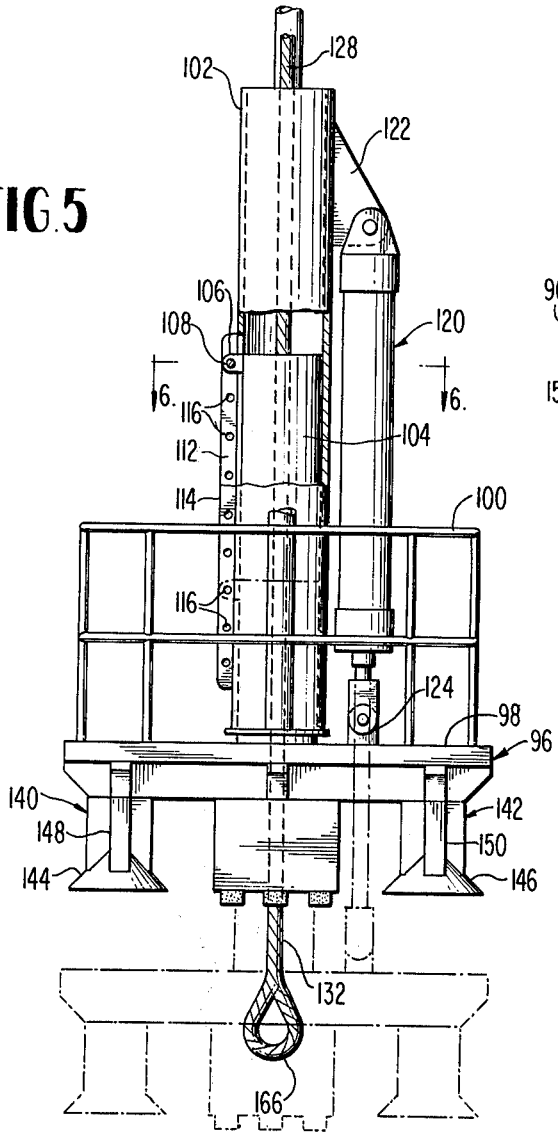
Figure 7:
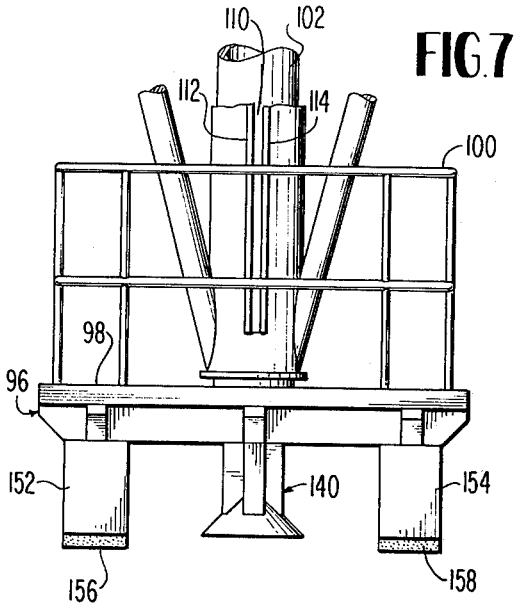
Figure 6:
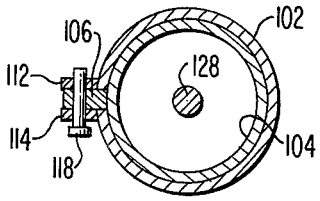
Figure 8:
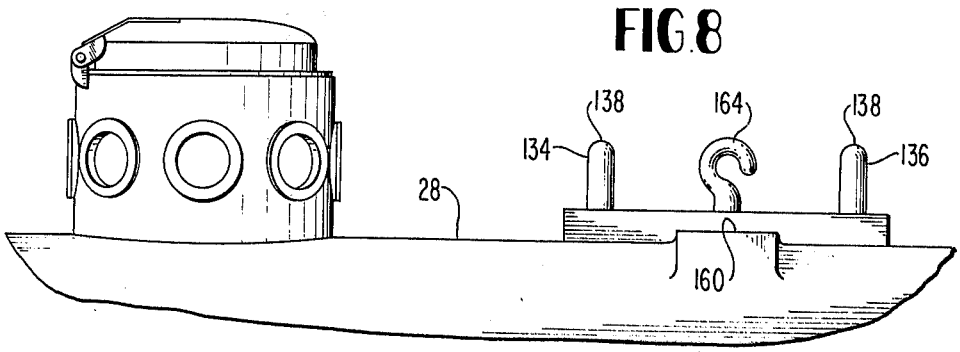
Figure 9:
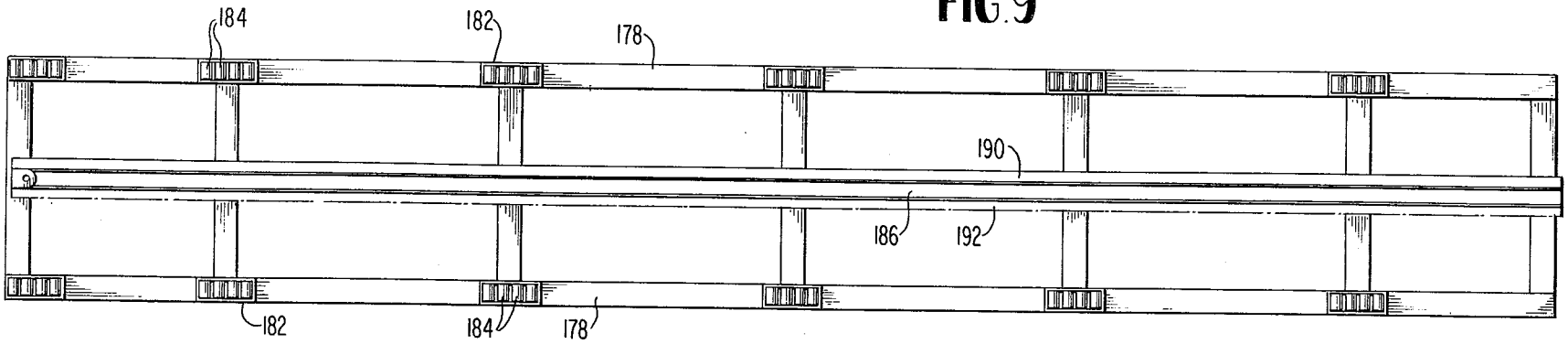
Figure 10:
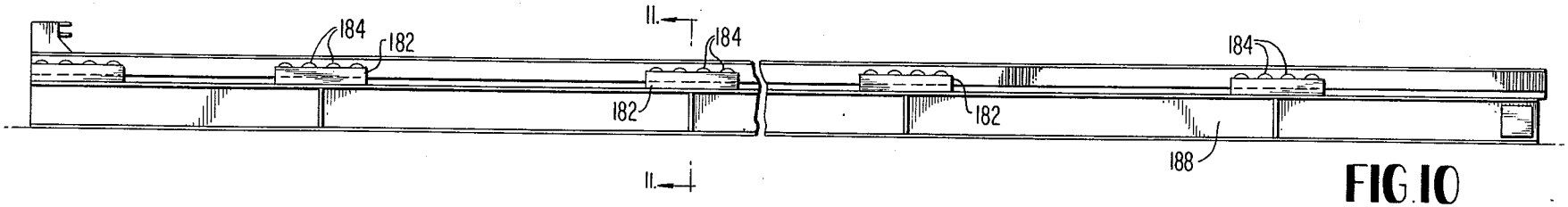
Figure 11:
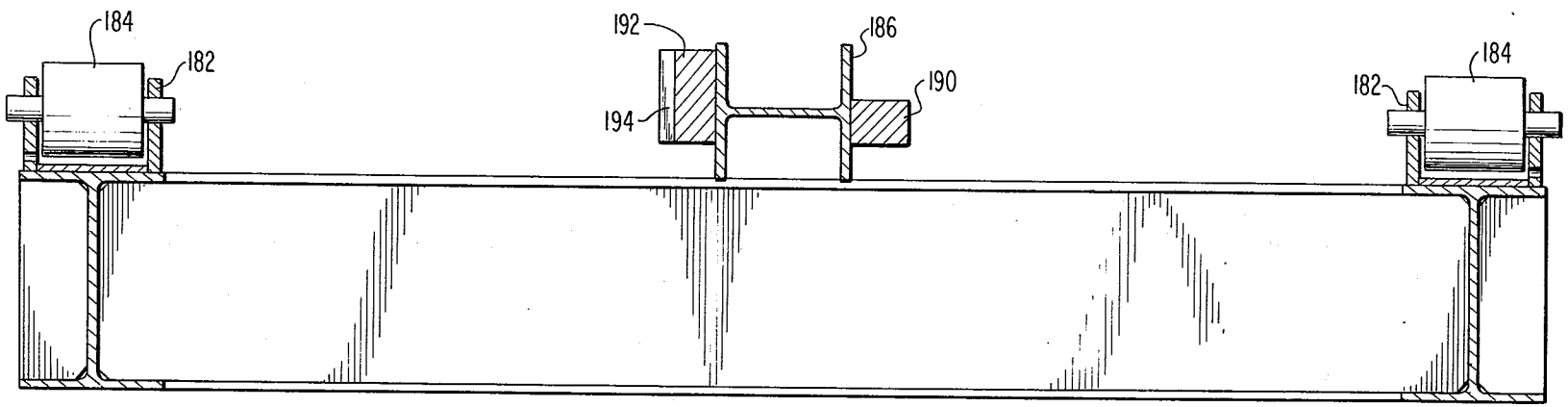
Figure 13:
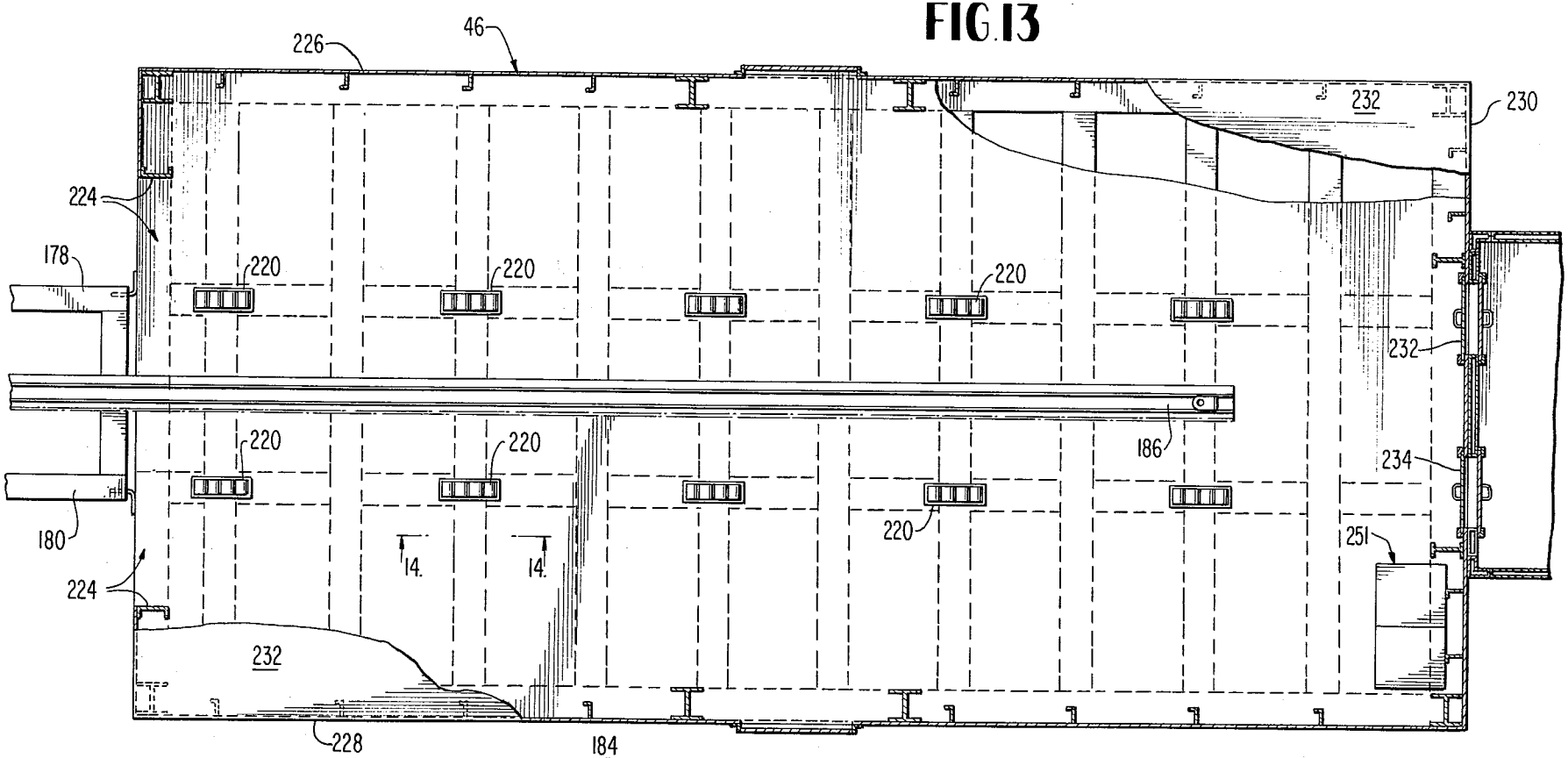
Figure 14:
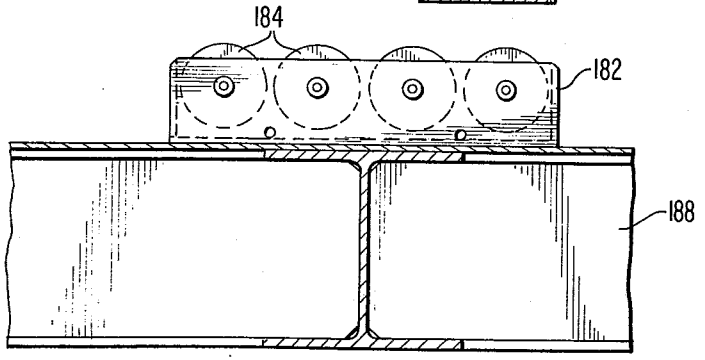
Figure 15:
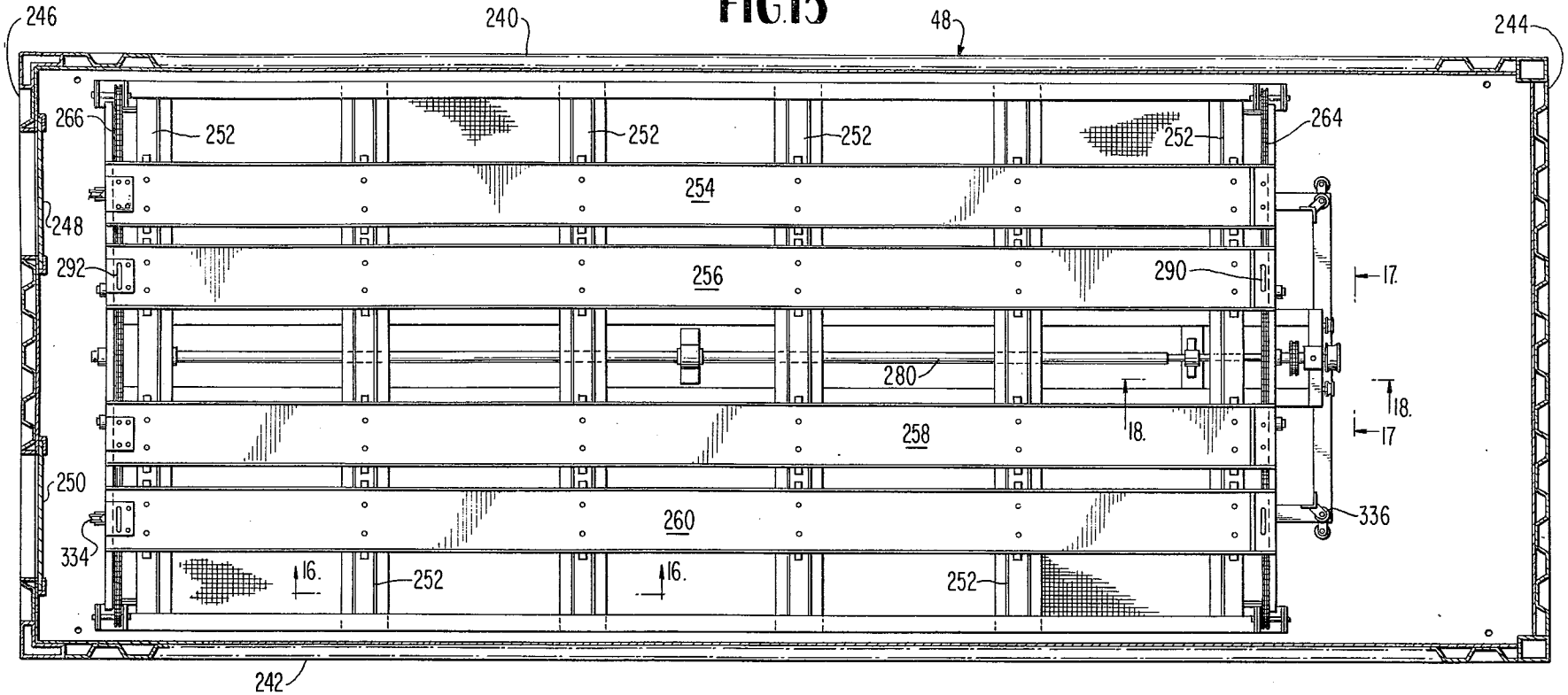
Figure 16:
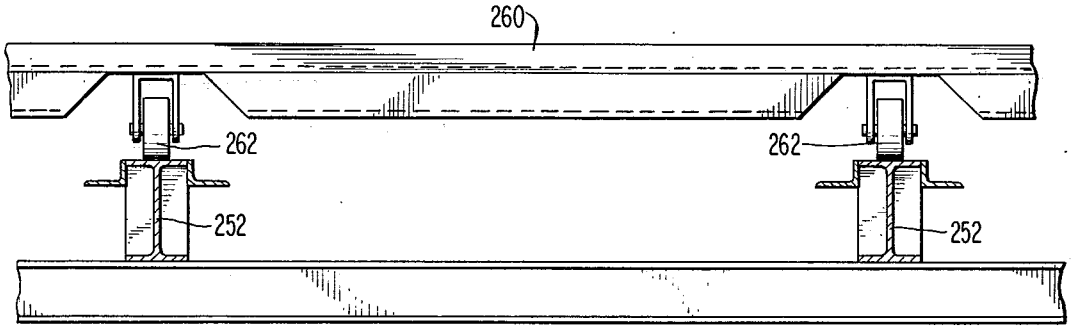
Figure 21:
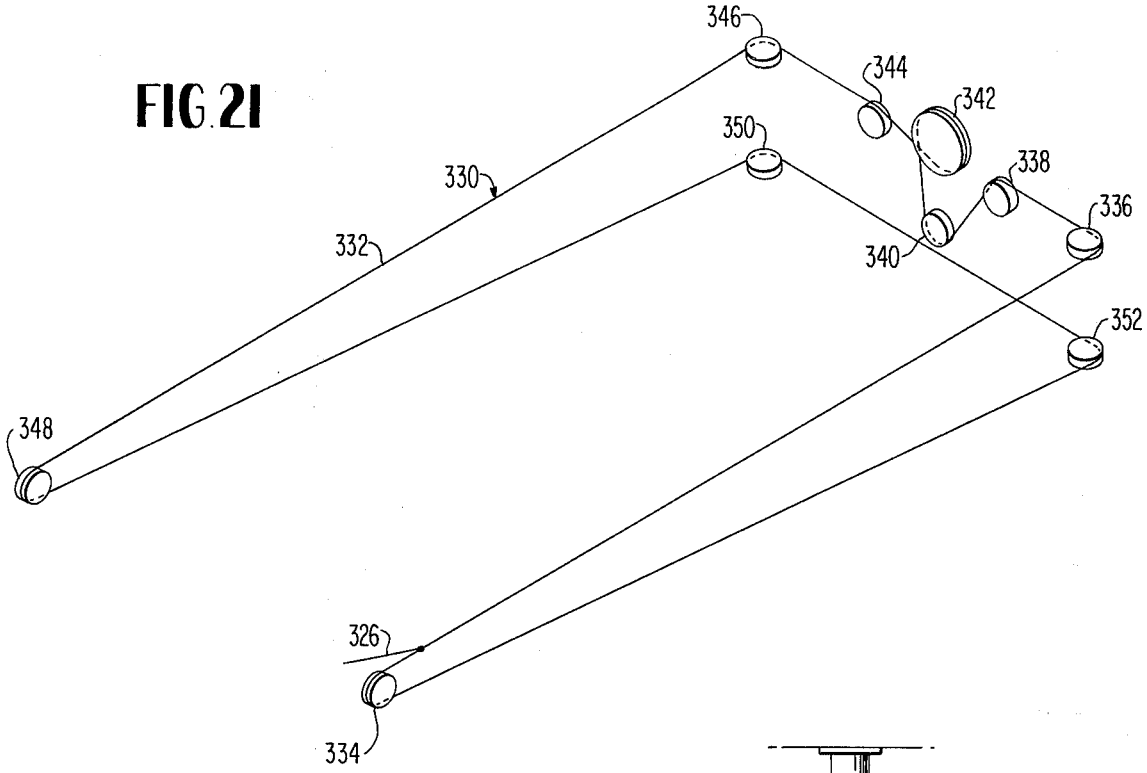
Figure 17:
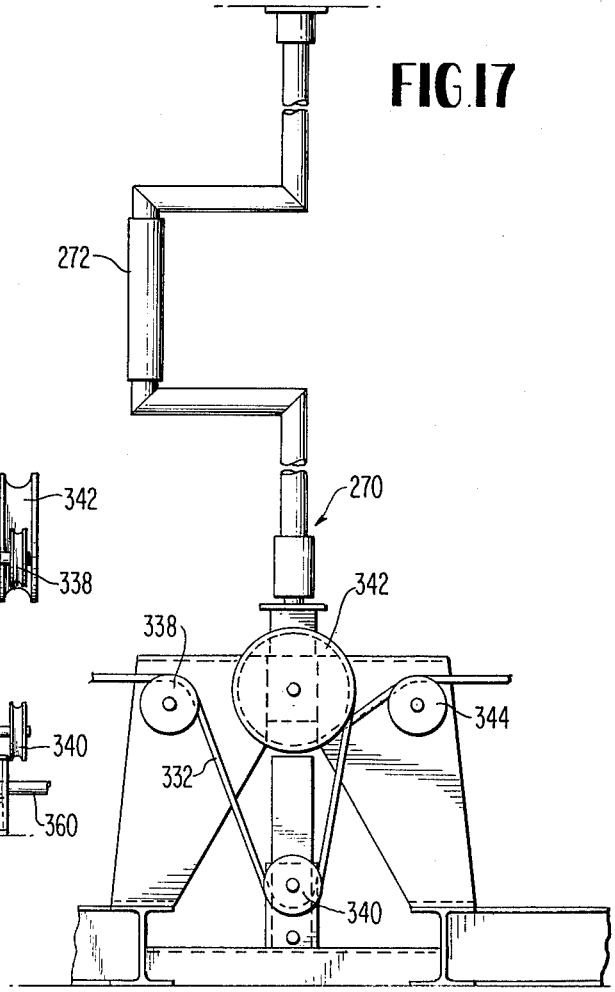
Figure 18:
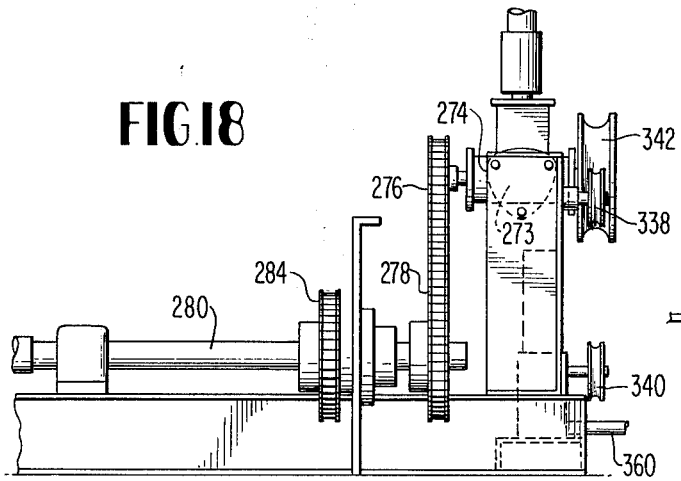
Figure 19:
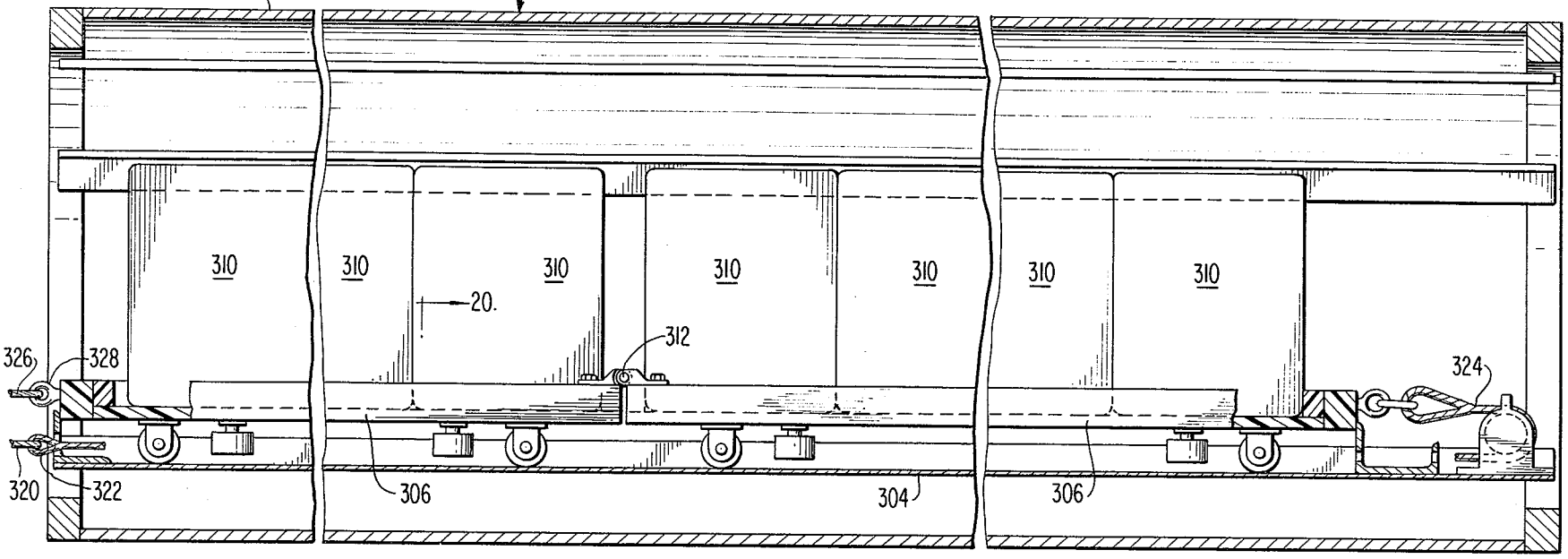
Figure 20:
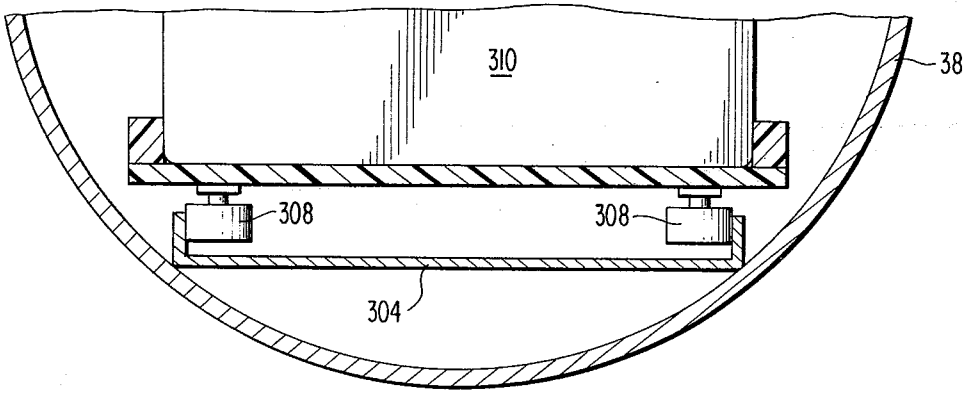
Figure 22:
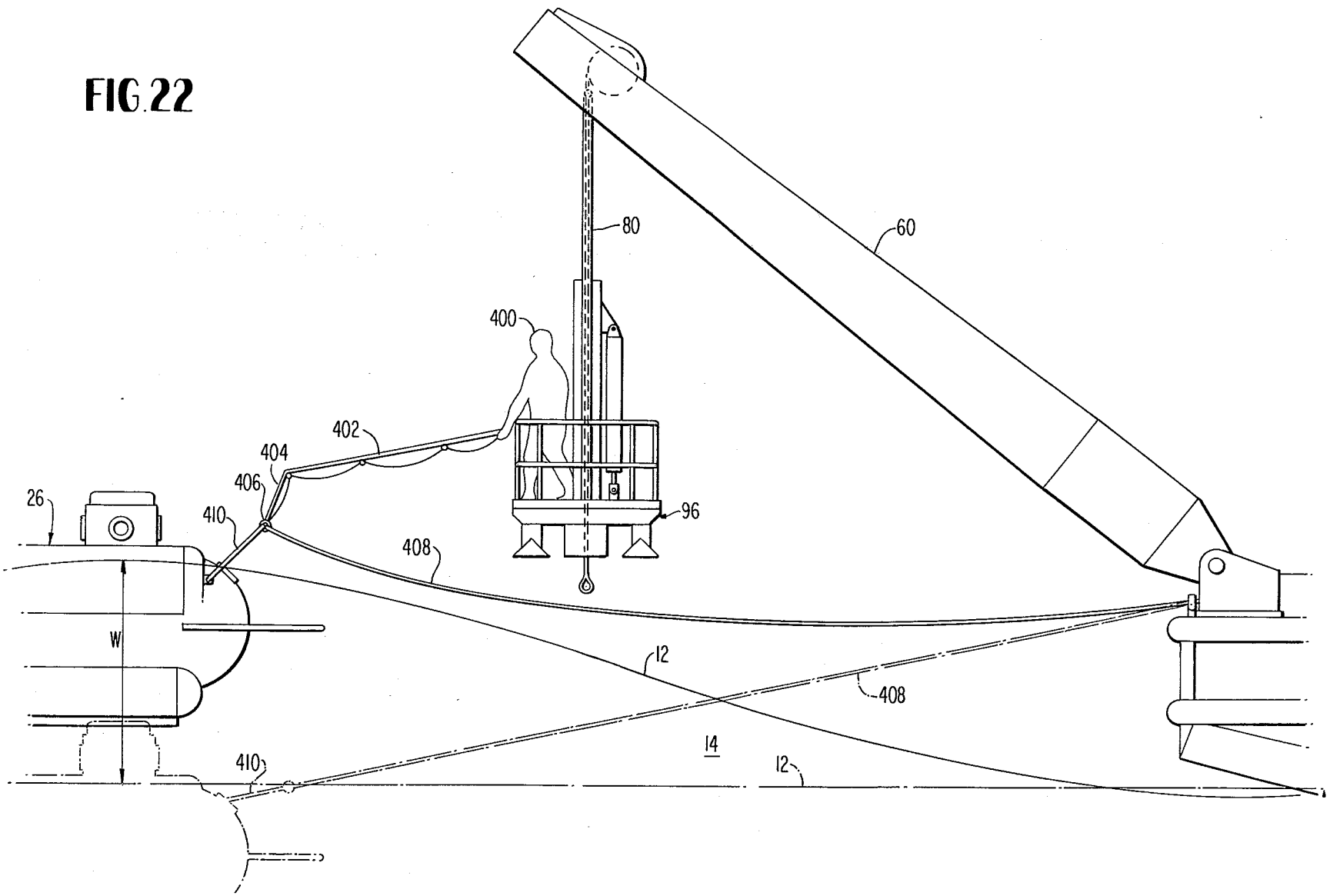

FIG. 4 discloses an end elevational view of first and second frame members and a platform carried by the second frame member and being operable to securely and rapidly mate onto a submersible for launching and retrieving the submersible;

FIG. 5, note sheet 4, discloses a detailed side elevational view of a platform assembly and apparatus for vertically raising and lowering the platform with respect to the second frame member as disclosed in FIG. 4;

FIG. 6 is a cross-sectional detailed view taken along section line 6—6 in FIG. 5 and discloses telescoping tubular cylindrical members which function to guide vertical movement of the platform with respect to the second frame;

FIG. 7 is a side detailed view of the platform assembly and particularly discloses mate on bearing pads and orthogonally postured mate on receiving cones;

FIG. 8 is a partial side elevation view disclosing a mate on assembly including a central hook, stanchions and bearing surfaces mounted upon the hull of the submersible;

FIG. 9 discloses a plane view of a parallel roller rail assembly mounted upon the deck of the mother vessel for transporting the submersible upon the deck for servicing the submersible;

FIG. 10 is a side elevation view of the rail assembly disclosed in FIG. 9;

FIG. 11 is a cross-sectional detailed view taken along section line 11—11 in FIG. 10 and discloses parallel track roller assemblies and a centrally located guide rail and drive rack;

FIG. 12, note sheet 3, discloses a partial detailed end view of a submersible mounted upon a transport cradle which in turn is carried by the parallel track roller assemblies and driven by a rack and pinion assembly;

FIG. 13, note sheet 6, discloses a plane view of the interior of a submersible service enclosure mounted upon the deck of the mother vessel;

FIG. 14 discloses a detailed sectional view of a roller unit as taken along section line 14—14 in FIG. 13;

FIG. 15 is a plan view of a power cell service enclosure including a rapid transfer tray assembly for handling banks of dolly mounted power cells;

FIG. 16 is a cross-sectional detailed view of a lateral translation carriage as taken along section line 16—16 in FIG. 15;

FIG. 17 is a partial elevational view taken in the direction of site 17—17 in FIG. 15 and discloses a hand operated drive assembly for handling banks of dolly mounted power cells longitudinally with respect to laterally translatable trays within the power cell service enclosure;

FIG. 18 discloses a detailed cross-sectional view taken along section line 18—18 in FIG. 15;

FIG. 19 is a schematic axonometric representation of an endless wire rope system used to translate dollies of power cells longitudinally along the laterally translatable trays mounted within the power cell service enclosure;

FIG. 20 is a detailed cross-sectional view of a power pod carried along the port and starboard sides of the submersible;

FIG. 21 is a partial cross-sectional view taken along section line 21—21 in FIG. 20 and discloses a power cell mounted upon a carrying dolly which is laterally guided by support rollers; and FIGS. 22–26 schematically disclose a sequence of operation for engaging a floating submersible, mating the submersible onto a vertically adjustable platform, lifting the submersible onto the stern of a mother vessel, and translating the submersible into a submersible housing for servicing such as replenishing the power cells carried within submersible the power pods.

DETAILED DESCRIPTION

Figures 1, 2:
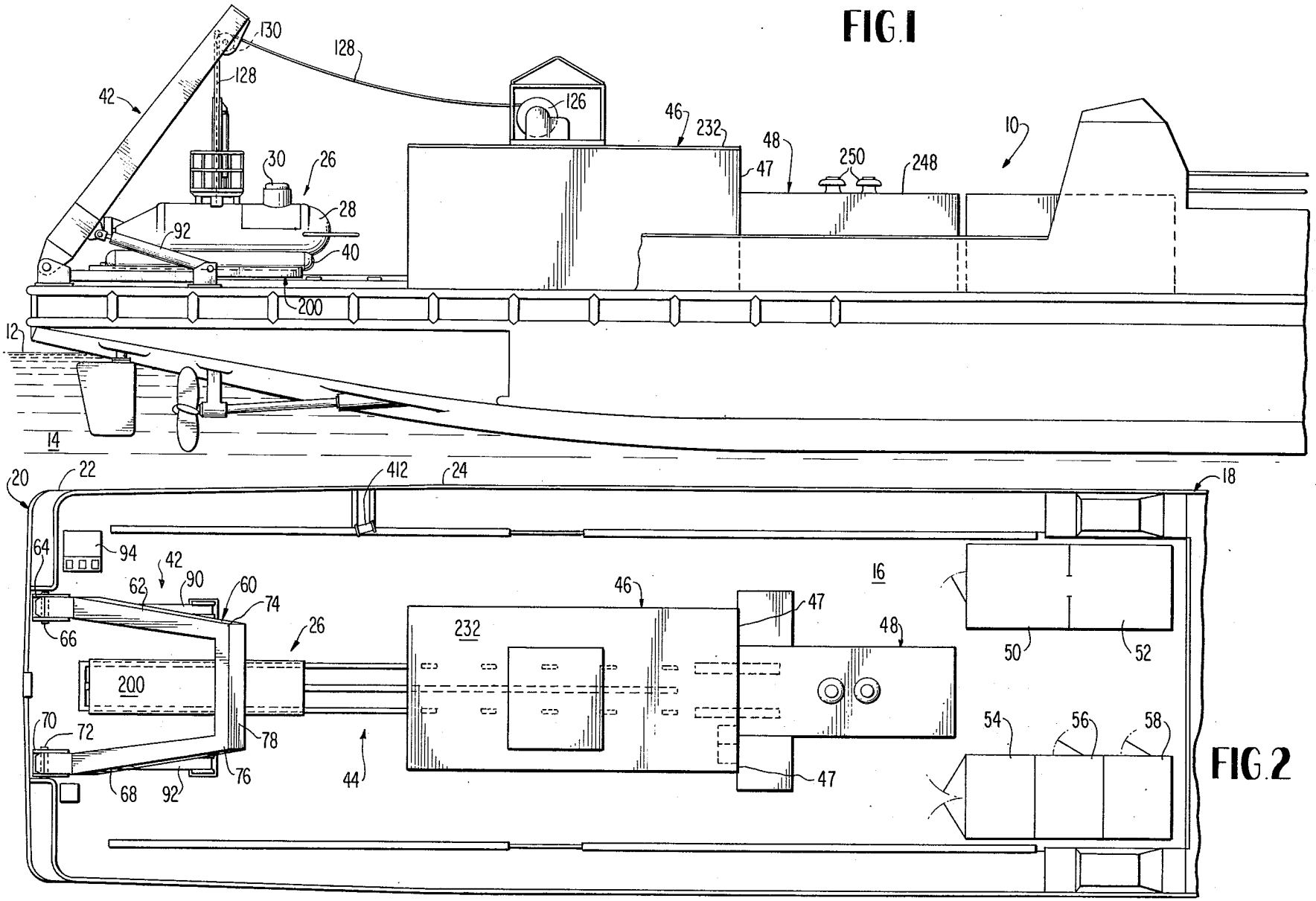
FIG. 1 is a side elevation view of a mother or tender vessel and a submersible carried upon the stern thereof.
FIG. 2 is a plane view of the mother vessel disclosed in FIG. 1 including apparatus according to the subject invention for launching, retrieving, and servicing the submersible.
Figure 3:
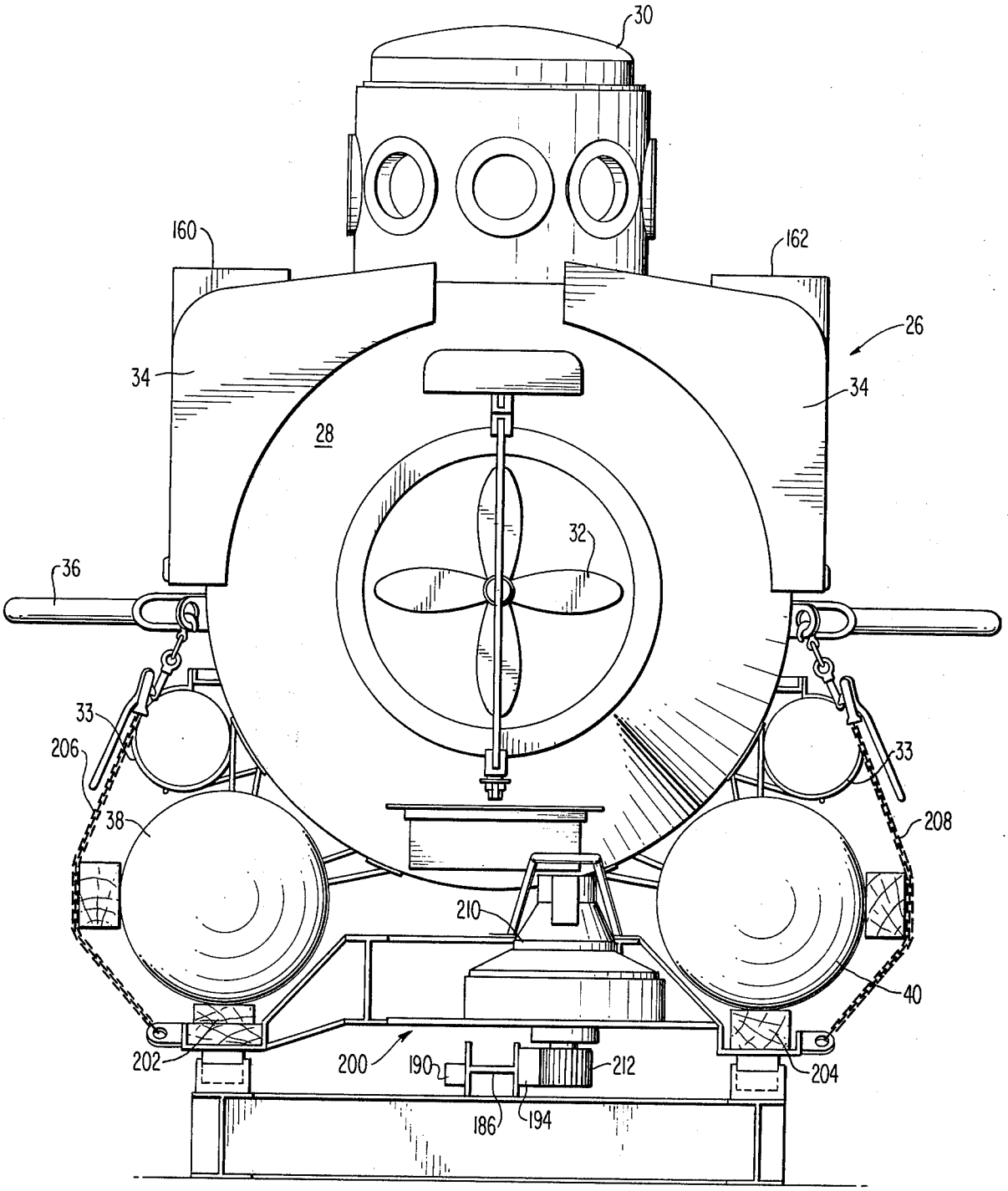
FIG. 3 is an end elevational view of a submersible mounted upon a carrying cradle which in turn is mounted upon parallel roller rails.

Overview of the General Structure, Operation, and Environment of the Invention Prior to describing in detail the method and apparatus for launching, retrieving, and servicing a submersible according to the present invention, it may be useful to refer, in conjunction with FIGS. 1, 2 and 3, to the general structure, operation, and environment of the invention.

With particular reference to FIGS. 1 and 2, there will be noted a mother vessel 10 generally floating upon the surface 12 of a body of water 14. The mother vessel 10 is preferably of a type having a generally planar, unobstructed, open deck area 16 stretching from generally a midship, as at 18, to the stern 20. The periphery of the generally open deck area 16 is bounded by a bulwark 22 and gunwale 24.

Such vessels often have utility as transport craft of the type for carrying tubular conduits to offshore drilling installations and the like. Such vessesl have also been found to be particularly suitable for launching, retrieving, and servicing an untethered, self-propelled, deep diving craft, or submersible 26 (note FIGS. 1 and 3).

The submersible 26 may be of a conventional design and typically is constructed with a pressure resistant watertight hull 28, having a hatch 30 located in an upward and forward position. Propulsion for the submersible 26 is provided by a suitable propulsion unit which drives a screw 32. Elements for controlling the environment within the submersible, navigational equipment, video tape equipment, and other systems are mounted within the submersible in a conventional manner. Ballast tanks 33 are provided for use in controlling the buoyancy of the submersible. A shroud structure 34 is connected to the hull of the submersible to protect instruments and other equipment connected to the exterior of the hull. Protection for the ballast tanks 33 and shroud 34 is provided by a guard rail 36 which surrounds the hull 28.

As is typical with deep diving, self-propelled submersibles, the systems associated with the vessels are electrically powered. In this connection, port and starboard pods 38 and 40 are mounted upon the hull 28 to house power cells providing energy to the submersible. The pods 38 and 40 constitute high pressure cylinders which are interiorally fitted with trays to receive banks of dolly mounted power cells. In this connection, each pod may be capable of receiving 25 or more twelve-volt direct current power cells, fuel cells, or banks of other suitable sources of electrical energy.

The submersible 26 is launched and retrieved from the stern 20 of the mother vessel by means of a dual swinging frame assembly 42. Servicing operations are conducted aboard the mother vessel in the open deck area 16. During this servicing, the submersible 26 is translated by a handling system 44 into and out of a service housing 46. Abutted against the forward wall 47 of the service housing 46 is an enclosure 48 wherein the banks of power cells within the pods 38 and 40 of the submersible may be retracted, charged, and replaced with facility in a rapid and reliable manner.

Servicing the submersible within the enclosure 46 is facilitated by supplemental equipment maintained in other enclosures forwardly positioned on the port and starboard sides of the vessel. These enclosures include a mechanic's room 50 and an electronics room 52 on the port side, and rooms 54, 56 and 58 on the starboard side of the vessel, which house air compressors, oxygen pumps, and an inventory of parts, respectively

Launching and Retrieving System

Frame Assemblies

Referring most particularly now to FIGS. 1, 2 and 4, dual swinging frame assembly 42 mentioned in the preceding will be described in more detail. The dual frame assembly includes a first frame member 60 having a first or port leg 62 pivotally connected to the stern of the mother vessel 10 by means of a bracket 64 and a cylindrical bearing pin 66. The first frame 60 also includes a second or starboard leg 68 which is likewise connected to the stern of the mother vessel 10 by means of a bracket 70 and cylindrical bearing pin 72. The upper or free ends 74 and 76 of the legs 62 and 68, respectively, are interconnected by a transversely extending member 78. Preferably, the legs 62 and 68 slope from the base portions thereof mutually inwardly and thus may be generally considered to form a pivotal A-frame at the stern of the mother vessel 10.

The dual frame assembly 42 is further comprised of a second frame member 80 which includes a first or port leg 82 and a second or starboard leg 84 each respectively pivotally connected at bases 86 and 88 thereof to the transverse member 78 of the first frame member 60. Preferably, the second frame 80 takes the form of an inverted A-frame and is free to swing and assume a plumb position notwithstanding inclination of the first frame member 60. Alternatively, and in order to reduce potentially undesirable swinging motions of the second frame 80, friction clutches or disk brakes may be applied at the pivotal connections to minimize the free-swinging or pendular movement of the second frame member 80.

The first frame member 60 is pivotally controlled at the stern of the mother vessel 10 by dual piston and cylinder arrangements 90 and 92 which extend from the deck 16 of the vessel to the port and starboard legs 62 and 68 of the first frame, respectively. Actuation of the piston and cylinder assemblies 90 and 92 is controlled from a console 94 positioned on the port side at the stern of the mother vessel 10.

Platform Assembly

Turning more particularly now to FIG. 4, a platform or crow's nest 96 includes a personnel deck 98 and a safety rail 100 and is connected to the dual frame 42 generally at the apex of the second frame 80. More particularly, a tubular, cylindrical sleeve 102 extends between the legs 82 and 84 of the second frame and joins with the legs at the apical connection thereof.

A similar tubular cylinder 104 is fixedly connected to the deck 98 of the platform and coaxially extends into the outer sleeve 102 in an intimate sliding and guiding relation with the interior, cylindrical surface thereof.

A normally projecting tongue 106 is rigidly connected to an upper end of the tubular cylinder 104 and is provided with a central aperture 108. A slot 110, perhaps best seen in FIG. 7, is fashioned in the wall of the sleeve 102 and the tongue 106 is intimately received therethrough. The slot 110 is flanked by flanges 112 and 114, each of which is provided with a plurality of periodic apertures 116. The apertures 116 of each flange register horizontally with a similar aperture in the opposing flange. Thus, the tongue 106 can be positioned so that the aperture 108 therein registers with a pair of apertures in the flanges and by locking bolt 118 (see FIG. 6) can be inserted therethrough to lock the interior cylinder 104 relative to the sleeve 102.

Referring now to FIG. 5, a piston and cylinder assembly 120 can be seen pivotally connected to opposite ends thereof between a strut 122 mounted upon an upper end of the sleeve 102 and link 124 mounted on the platform 96. The piston and cylinder assembly 120 is employed to selectively vertically adjust the position of the platform 96 relative to the inverted A-frame of the second frame 80. The platform may then be raised and lowered as required during the launching and retrieving operation to be discussed in detail hereinafter.

The Platform and Submersible Connecting Assembly

Referring again to FIG. 1, there will be seen a winch 126 of the type commonly referred to as a constant tension winch. A flexible connector in the form of a nylon cable 128 is wound at one end on the winch 126 and extends over a sheave 130 carried by the transverse member 78 of the first frame member 60 (see FIG. 4). The flexible connector 128 freely passes over the sheave 130 and descends vertically through the platform. As can be seen most clearly in FIGS. 5 and 6, the tubular cylinder 104 and the sleeve 102, each being tubular in character, permit the flexible connector 128 to freely descend coaxially through these members and to exit at 132 below the platform 96.

Referring now more particularly to FIGS. 5, 7 and 8, an assembly for rapidly and securely unifying the hull of the submersible with the platform assembly 96 can be seen. In this regard, the hull 28 of the submersible is provided with a pair of opposed stanchions 134 and 136. The stanchions have upper rounded noses 138 and can be received within cylindrical sockets 148 and 150 which are mounted on the underside of the platform 96. Conical guides 144 and 146 are connected over the mouths 141 and 143 of the sockets 148 and 150 and project downwardly therefrom. Gusset plates 140 brace the connection between the sockets and the conical guides. The conical guides 144 and 146 serve to funnel the stanchions 134 and 136 into the cylindrical sockets 148 and 150. The sockets 148 and 150 are dimensioned to snugly receive the stanchions 134 and 136 and thus help to securely interconnect the hull of the submersible and the platform 96.

The stability of the connection discussed in the foregoing is enhanced by bearing pads 152 and 154 which are orthogonally offset relative to the sockets 144 and 146 and which normally project downwardly from the underside of the platform 96. The bearing pads carry resilient contact surfaces 156 and 158 which bear upon bearing shoulders 160 and 162 disposed on the hull of the submersible when the stanchions are inserted into the sockets (see FIGS. 3 and 8).

Centrally located between the bearing shoulders 160 and 162 and the stanchions 134 and 136 is a catch hook 164 which may engage and capture an end loop 166 of the cable in a manner to be discussed more fully hereinafter.

Handling System for the Submersible on the Deck of the Mother Vessel

Turning now to FIGS. 1, 9 and 10, a system 44 for handling the submersible on board the mother vessel is depicted.

The handling system 44 includes a track comprised of a parallel assembly of aligned rollers 178. The assembly of aligned rollers each includes regularly spaced brackets 182 which carry a plurality of cylindrical bearing rolls 184.

An H-frame 186 is mounted on the superstructure 188 of the deck of the mother vessel. The H-frame carries an alignment rail 190 and a rack 192 having a plurality of teeth 194. The alignment rail 190 and the rack 192 are employed, respectively, to guide and effect movement of the submersible as will be hereinafter more fully described.

Referring now to FIGS. 3 and 12, the submersible 26 can be seen mounted upon a low profile cradle 200. The cradle longitudinally extends beneath the submersible 26 and the pods 38 and 40 of the submersible rest upon longitudinally extending bearing blocks 202 and 204. The submersible 26 is releasably connected to the carrying cradle 200 by means of flexible connectors 206 and 208.

The cradle 200 carries a motor 210, shown in FIG. 3, which drives a pinion gear 212 positioned in mating engagement with the rack 194. An L-channel 204 shown in FIG. 12 moves along the rail 190 and a plurality of downwardly projecting guiding pairs of rollers 216 engage one flange of the H-frame 186 as at 218 to direct the movement of the cradle along the H-frame. Through operation of the rack and pinion drive train, the cradle 200 may be selectively translated along the parallel assembly of aligned rollers 178.

As perhaps best illustrated in FIG. 2, the handling system 26 extends from a position near the stern of the mother ship along the deck 16 midway between the port and starboard sides toward the bow of the vessel.

Referring now to FIGS. 13 and 14, it will be noted that the parallel assembly of aligned rollers 178 extends to a service housing 46 as mentioned in connection with an earlier discussion of FIGS. 1 and 2. The assembly is comprised of individual brackets 182 which are positioned upon superstructure 188 in a posture of alignment with the H-frame 186. The brackets 182 are each fitted with a set of bearing rolls 184 which supportingly engage the underside of the cradle 200. The H-frame 186 extends through a doorway 224 in the service housing 46 and projects to the end of the housing closest to the bow of the mother vessel. Thus, the submersible, once on the cradle, can be moved away from the first and second frames and into the service housing.

The service housing 46 includes vertically extending side walls 226 and 228, end wall 230, and a roof or ceiling structure 232. Thus, once the submersible has been received, it can be sheltered from adverse weather conditions as deck hands service the vessel. The end wall 230 is fitted with sliding doors 232 and 234 which are in alignment with the rollers 184. These doors are further each longitudinally aligned with one of the power pods 38 and 40 resting on the cradle 200.

Servicing System for the Power Cells of the Submersible

The Servicing Enclosure

Servicing of the power cells of the submersible is conducted within a recharging enclosure 48, which is illustrated in FIGS. 1, 2 and 15. The recharging enclosure 48 includes side walls 240 and 242, a forward end wall 244, and a rear end wall 246. The enclosure 48 is covered with a roof 248 which is fitted with mushroom vents 250. The vents 250 form a part of a ventilating system (not shown) which continuously circulates air through the enclosure 48 to maintain the atmosphere therein free of excessive concentrations of hydrogen which might accumulate during the charging of power cells. In this regard the cells are recharged by diesel powered generators (not shown) mounted on the mother vessel which feed through transformers 251 (note FIG. 13) to banks of power cells stored within enclosure 48.

The aft end of the chamber 48 is provided with sliding door panels 248 and 250 which are in axial alignment with sliding door panels 232 and 234.

The Supporting and Shifting System for the Power Cells

Positioned within the interior of enclosure 48 is a system for facilely handling power cells. The system includes a plurality of transverse rails 252 which are supported and restrained by appropriate underframing and which underlie longitudinally extendiing trays 254, 256, 258 and 260. As illustrated in FIG. 16, the trays are mounted on dollies 262 which in turn ride the rails 252. The dollies permit convenient transverse positioning of the trays within the enclosure 48.

Transverse movement of the longitudinally extending trays 254–260 is effected by two endless chain assemblies 264 and 266 extending parallel to the rails 252 and mounted at the fore and aft ends, respectively, of the underframing.

The endless chains are driven by a hand-cranked mechanism 270 perhaps best illustrated in FIGS. 17 and 18. The mechanism includes a handle 272, a clutch 273, and a gear box 274. A drive shaft 275 extends from the gear box 274 and carries a sprocket 276. A drive chain 277 passes over the sprocket 276 and around a similar sprocket 278. The sprocket 278 is connected to a drive shaft 280 which extends longitudinally through appropriate pillow blocks beneath and parallel to the trays. Two further sprockets 284 and 285 are mounted at the proximal and distal ends, respectively, of the drive shaft 280 relative to the gear box 274 and serve to engage the endless chains 264 and 266. Forward and reverse movements of the chains can be effected as a matter of choice in the direction the handle 272 is rotated.

The trays may be selectively connected at opposite extremes thereof to the chains 264 and 266 by means of U-shaped pin connectors 290 and 292 which extend through the trays and links of the endless chains 264 and 266.

The Pods of the Submersible

Referring now to FIGS. 19 and 20, detailed sectional views can be seen of a pod 38 which, as previously indicated, is attached to the port surface of the submersible 28.

Each pod is characterized by a generally cylindrical, outer shell 302 and a longitudinally extending tray 304 mounted within the interior thereof. The tray 304 supports a series of articulated dollies 306. As the dollies 306 translate upon the tray 304 their movement is guided by rollers 308.

The dollies 306 carry a plurality of power cells 310 such as direct current storage batteries. The articulation of the dollies 306 is afforded in a preferred form by periodic pivotal interconnects as at 312 between adjacent segments of the dolly assembly. The pivotal connections permit the accommodation of vertical misalignments between the dollies and the tray and thus minimize any tendency of the trays or the power cells to become lodged against the sides of the shell 302.

The System for Removing and Replacing the Power Cells

Referring now more particularly to FIGS. 15 and 17–21, there will be seen a system for removing and replacing an entire series of dollies and power cells housed within a pod of the submersible. Once the cradle carrying the submersible 26 is translated to the forward end of the submersible enclosure 46, the forward ends of the battery power pods 38 and 40 may be uncovered and doors 232, 234, 248 and 250 raised. A first flexible cable 320 may then be clipped to a lower eye 322 of a flexible cable 324 passing over a pulley 323 anchored to a rear portion of the pod (see FIG. 19). A second flexible cable 326 may then be clipped to the upper eye 328 which is in turn affixed to the forwardmost dolly of the series of dollies within the pod. The other end of flexible cable 326 may be connected to an endless cable assembly 330 which underlies the longitudinally extending trays 254–260.

As illustrated in FIG. 21, the endless nylon cable 332 passes over a series of sheaves, including first and second sheaves 334 and 338 which are in axial alignment with doors 250 and 248, respectively. The cable 332 extends from sheave 334 to an upper sheave 336 which guides the cable to a first aligning sheave 338 and down to a tensioning sheave 340. From the tensioning sheave 340 the cable 332 passes over a driving sheave 342 in a counterclockwise loop and then over a second aligning sheave 344 to a sheave 346. From the sheave 346 the cable 332 passes to the second sheave 348 and back beneath the tray assemblies to two more sheaves 350 and 352 to complete the closed loop.

In operation the cable 326 is selectively connected by means of a suitable fastener to the endless cable 332. An operator depresses a lever 360 as shown in FIG. 18 with his foot. As the lever 360 and the tensioning sheave 340 are connected, the tensioning sheave is depressed and the cable 332 is tightened about the driving sheave 342. After the clutch 273 of gear box 274 has been disengaged, the handle 272 may then be cranked to draw the endless cable 332 about the sheave system discussed previously. The entire series of dollies and power cells can then be withdrawn from the pod of the submersible and onto, for instance, a tray 260, previously translated as described earlier into alignment with the door 250. Once the series of dollies and power cells has been completely drawn onto tray 260, the lever 360 may release and the clutch 273 of the gear box 274 can be engaged and the endless chains 264 and 266 employed to transfer tray 260 out of alignment with door 250. Tray 258, which carries a series of previously charged power cells on articulated dollies, may then be concurrently moved into alignment with door 250. The clutch 273 of the gear box 274 for the endless chains 264 disengages and the cable 324 shown in FIG. 19 may be attached to the end 323 of the series of dollies. The underlying cable 320 may then be connected to the endless cable 332, the foot lever 360 again depressed, and the handle 272 manually rotated to tension lines 320 and 324 to draw the charged power cells into the pod. The foregoing procedure is normally repeated with respect to the port pod 38. Alternatively the transfer may be accomplished simultaneously by duplicating the foregoing steps as specifically discussed in connection with transferring a single power assembly into and out of pod 40.

THE LAUNCHING AND RETRIEVING SEQUENCE

Referring now to FIGS. 22 through 26, there are illustrated schematic views of a sequence of steps performed in retrieving a submersible according to a preferred embodiment of the invention.

The platform 96 is manned and suspended by the second frame 80 from the first frame 60. The first frame 60 is then pivoted to a posture in which it extends over the surface 12 of a body of water 14. A submersible 26 is depicted as floating generally on the surface 12 of the body of water in solid and phantom views to indicate the extent of vertical movement of the submersible attributable to wave action of the type which might exist in the North Sea.

The operator 400 is provided with a tool 402 having an extension 404 forming a dog leg. The tool is employed to connect sea painter 408 to a draw bar 410 mounted upon the bow of the submersible 26. The sea painter 408 is then taken in by a suitable deck winch 412 as shown in FIG. 2. The sea painter facilitates general longitudinal alignment of the major axis of the submersible with that of the mother vessel 10 and thus facilitates control of the submersible in rough seas.

Figure 23:
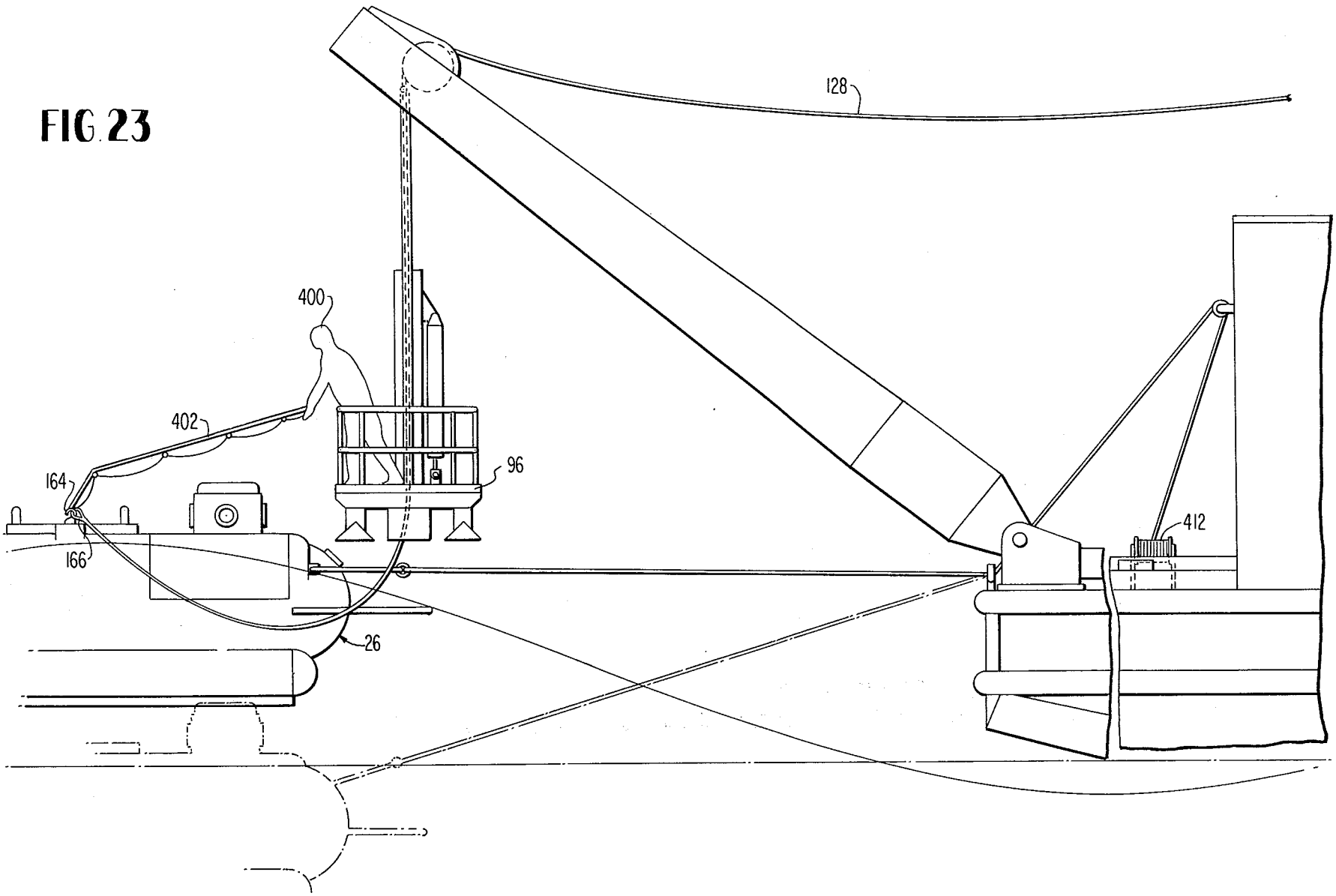

With renewed attention to FIG. 23, the operator 400 is shown placing the end loop 166 of the cable 128 in engagement with the catch hook 164. This operation is accomplished with the platform 96 in a position forward of the submersible 26 to minimize the possibility that the submersible may impact and damage the platform.

Figure 24:
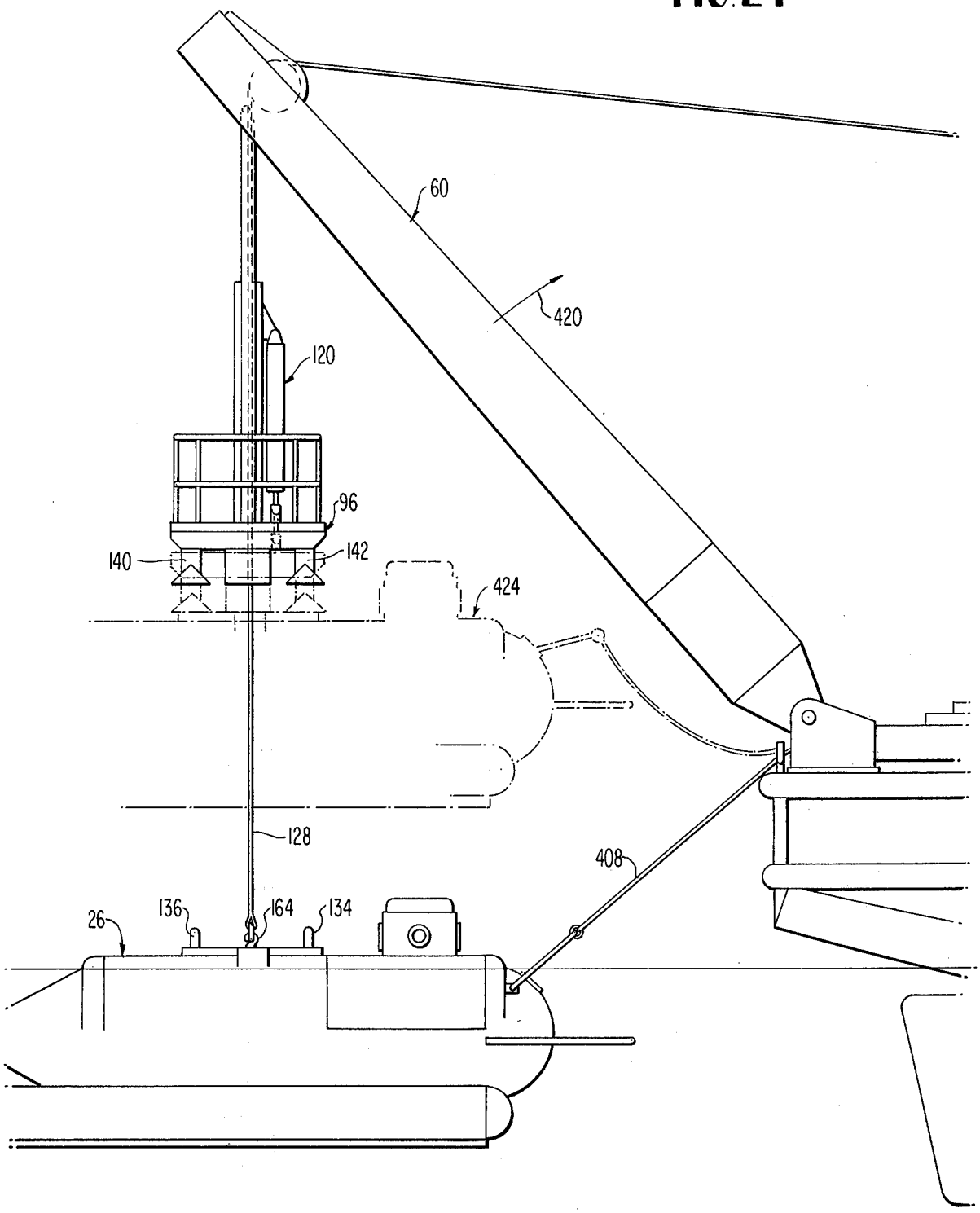

Once the cable 128 is in engagement with the catch hook 164, the frame 60 is pivoted clockwise toward the deck of the mother vessel in the direction of arrow 420 shown in FIG. 24. Tension is applied to the cable 128 by the constant tension winch 126 until the cable 128 at least partially supports the submersible 26. The submersible 26 is stabilized at this time by the forces exerted by the sea painter 408, the cable 128, and the lateral damping of the sea water.

It is critical at this point to control swinging or pendular movement of the submersible until it is securely positioned on the deck of the mother vessel. To control the pendular movement, the winch 126 is taken up to raise cable 128. Simultaneously the piston and cylinder assembly 120 is actuated to translate the platform 96 downwardly toward the submersible. The combined downward movement of the platform 96 and the upward movement of the submersible 26 is illustrated in phantom in FIG. 24. This relative movement is continued until the stanchions 134 and 136 engage the conical guides 144 and 146 and the bearing shoulders 160 and 162 are engaged by the bearing pads 152 and 154 (see the phantom portion of FIG. 24).

Figure 25:
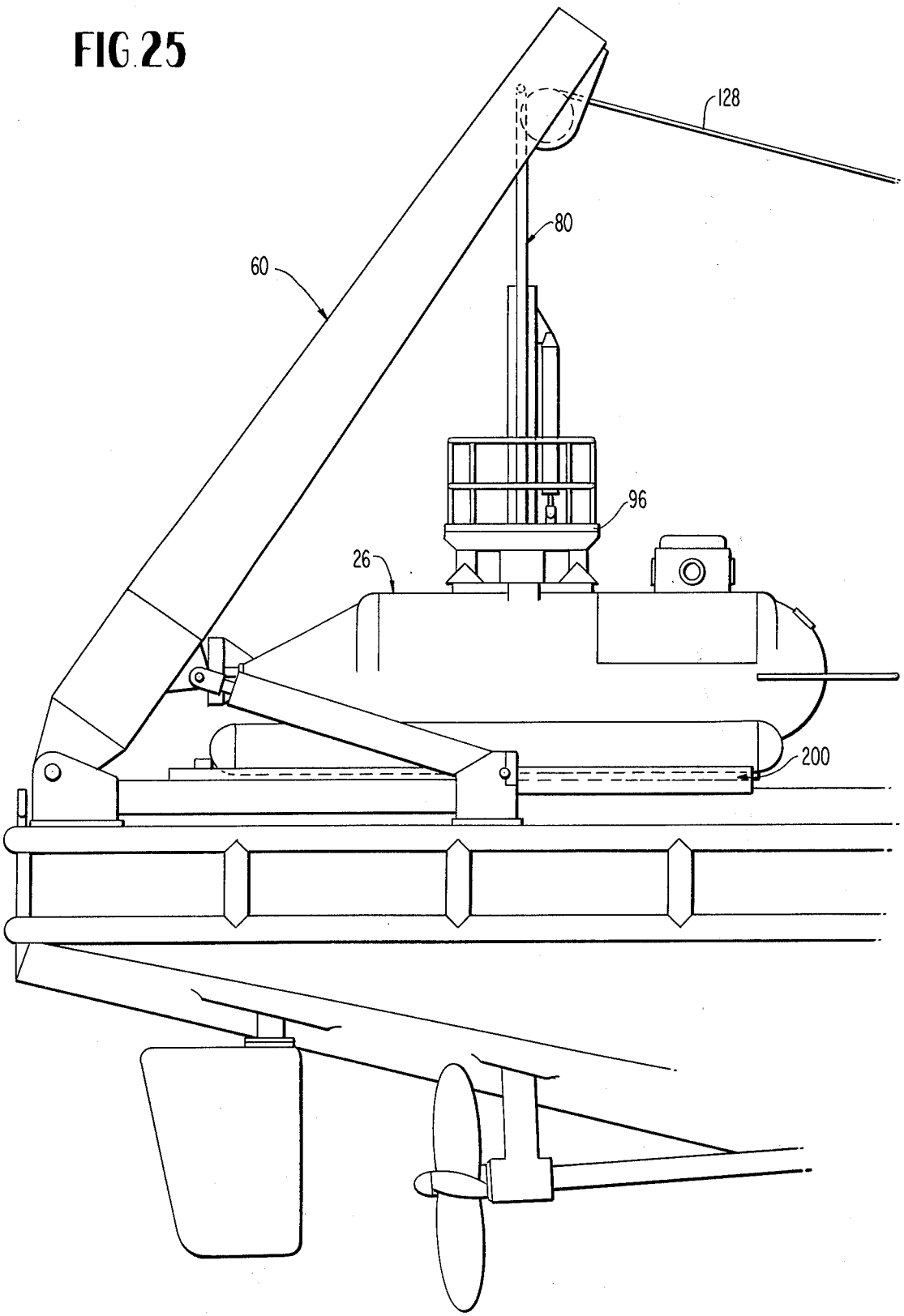

Referring now to FIG. 25, it will be seen that the next step is to pivot the first frame 60 to a posture in which the free end thereof overlies a desired location on the deck of the mother vessel 10. In this posture the submersible is normally positioned over the cradle 200. The second frame 80, being free to pivot, remains plumb during this step in the operation and the submersible 26 is rapidly and controllably positioned above the cradle 200. The submersible 26 is then securely connected to the cradle 200 and the platform 96 is raised so that the flexible cable 128 may be released from the catch hook.

Figure 26:
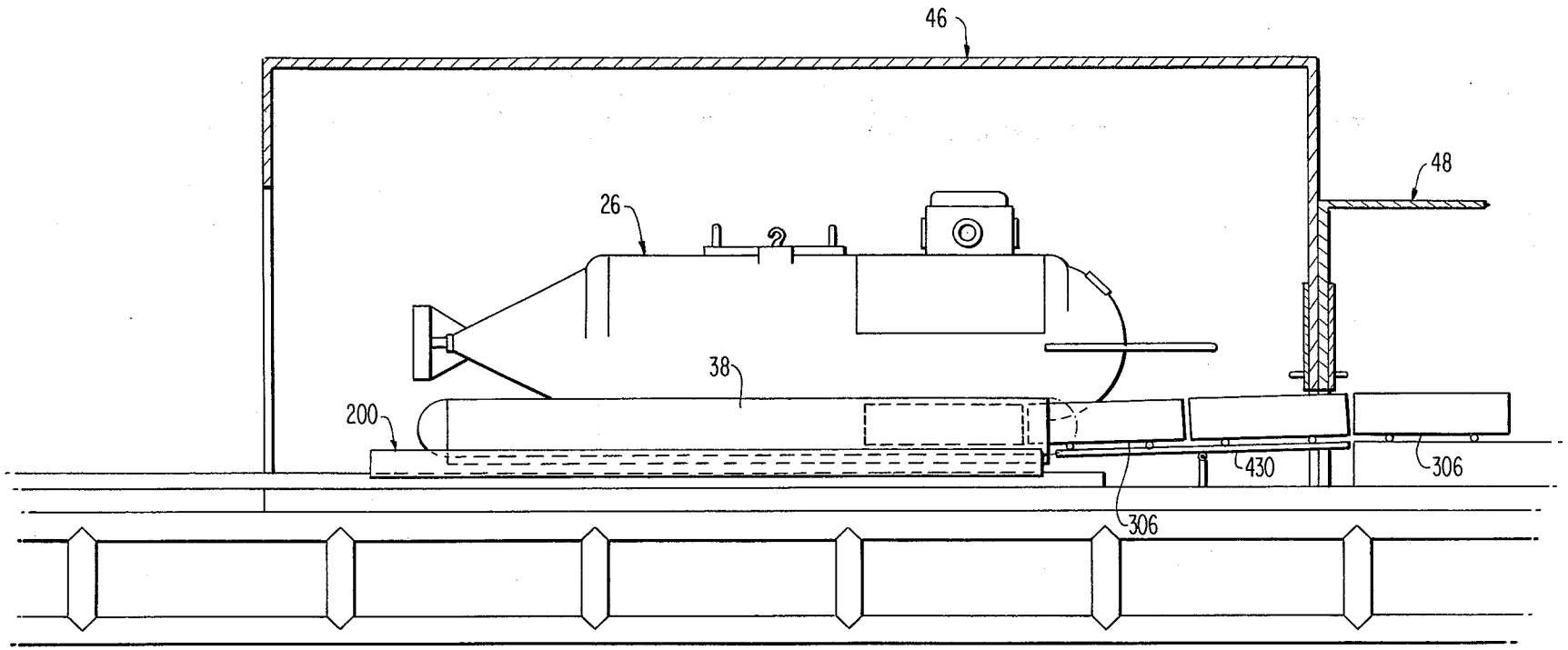

The motor 210 mentioned in connection with an earlier discussion of FIG. 12, is then actuated to drive the pinion gear 212 along the parallel assembly of aligned rollers until the submersible 26 is conveyed into the service housing 46, illustrated in FIG. 26. The cradle 200 is next secured to the deck of the service housing 46 and the pods 38 and 40 are uncovered. A bridging ramp 430 is then manually positioned between the open end of the pods and the doors 232, 234, 248, and 250, respectively of the service housing 46 and the recharging enclosure 48. The entire series of articulated dollies and power cells 306 are then translated into the recharging enclosure 48 to be charged. A previously charged series of power cells is moved into alignment with the emptied pods and is translated thereinto in accordance with the system described in connection with an earlier discussion of FIGS. 15 through 21. The foregoing procedure is then reversed and the submersible 26 is lowered into the body of water for continued work. It has been found that replacement of the power cells by means of the method and apparatus of the present can reduce the total servicing time of a submersible from approximately eight hours to approximately one and one-half hours.

SUMMARY OF MAJOR ADVANTAGES OF THE INVENTION

From the foregoing it should now be apparent that the present invention possesses numerous significant advantages over prior art systems.

One advantage resides in the dual frame assembly which is operable to mechanically support a manned platform to enable an operator to connect a sea painter and a flexible connector onto a floating submersible without entering the water surrounding the mother ship or the submersible.

Once the flexible connector is attached to the retrieving hook of the submersible and tension is applied rapid mate on with the platform is achieved by simultaneous taking up the winch and hydraulically lowering the platform. This technique minimizes spinning or swinging tendencies of the submersible hanging freely over the stern of the support vessel. An opposing stanchion and cone assembly and orthogonally postured bearing pads provides a secure and stable connection between the submersible and frame assemblies. The submersible is then mechanically and controllably pivoted onto the mother vessel with minimal danger to operators or personnel within the craft.

Once the submersible is positioned over the deck of the mother vessel it may be lowered and secured onto a unique deck mounted cradle assembly which is translatable by a rack and pinion assembly from a posture adjacent the stern of the mother vessel to approximately midship and within a service enclosure. Normal servicing of the submersible is thus facilitated by isolating operating personnel from potentially adverse weather conditions.

Power pods carried on the port and starboard portions of the submersible are then opened and dolly mounted banks of power cells are mechanically pulled into a battery service enclosure. Within the service enclosure, the batteries are carried on longitudinally extending transfer trays which function to rapidly and efficiently receive banks of spent cells, laterally shift out of alignment with the pods and realign a tray carrying a bank of freshly charged cells into alignment with the pods. Transfer into and out of the pods and onto the longitudinally extending trays is facilitated through the provision of articulated dollies which permit flexing of the bank of power cells during the transfer operation.

The battery servicing enclosure functions to isolate the power cell recharging center from adverse elements and is fully ventilated to minimize the possibility of hydrogen accummulation during a battery charging operation.

Although the invention has been described with reference to a preferred illustrated embodiment it will be appreciated by those skilled in the art that additions, deletions, modifications and substitutions and other changes not specifically described may be made which will fall within the perview of the appended claims.

What is claimed is:

1. An apparatus mounted upon a mother vessel for launching, retrieving, and servicing a submersible having at least one pod for the storage of dolly mounted power cells, said apparatus comprising:

a first frame member including first and second coplanar legs each pivotally mounted at one end thereof in a position generally adjacent a peripheral portion of the deck of the mother vessel, said first and second legs being rigidly connected at the free ends thereof and pivotable in unison to a posture wherein said other ends extend over the deck of the mother vessel or to a posture wherein said other ends extend over the surface of the body of water;

power means connected between said first frame member and the deck of the mother vessel for selectively pivoting said first frame member to a posture wherein said other ends of the said legs extend over the deck of the mother vessel or to a posture wherein said other ends of said legs extend over the surface of the body of water;

a second frame member pivotally connected at one end thereof to the free end of said first frame member;

a platform operably positioned adjacent the other end of said second frame member;

power means operably connected between said platform and said second frame member for selectively vertically adjusting said platform relative to said second frame member;

a winch connected to said floating vessel;

a sheave connected to said free end of said first frame member;

a flexible connector wound at one end thereof upon said winch, passing over said sheave, and extending downwardly through said platform for selective connection to the submersible, the submersible being movable by said flexible connector into engagement with said platform to securely mate the platform to the submersible, said first frame member being then operable to lift and swing the submersible from the deck of the mother vessel or the surface of the body of water with the submersible suspended from said second frame member;

a parallel assembly of aligned rollers connected to the deck of the mother vessel;

a cradle for carrying the submersible, said cradle operably resting for translation upon said parallel assembly of aligned rollers;

translating means connected to said cradle for translating said cradle along said parallel assembly of aligned rollers toward and away from said first frame;

a plurality of mutually parallel rails mounted transversely on the deck of the mother vessel;

a first tray longitudinally extending across said plurality of rails, and mounted for lateral translation upon said plurality of rails, said first tray being operable to support a plurality of charged power cells, said first tray being operable to be aligned with said at least one pod and longitudinally deliver a plurality of charged power cells into said at least one pod of the submersible;

a second tray longitudinally extending across said plurality of rails for lateral translation upon said plurality of rails, said second tray being operable to be aligned with said at least one pod and longitudinally receive a plurality of spent power cells from said at least one pod of the submersible;

a power assembly connected to the mother vessel for longitudinally pulling the power cells onto or off said first or second trays; and a power assembly connected to the mother vessel for selectively translating said trays along said plurality of rails to selectively align said trays with said at least one pod of the submersible.

2. An apparatus for launching, retrieving, and servicing a submersible as defined in claim 1, wherein:

said second frame member is comprised of first and second legs pivotally suspended at base portions thereof from the free end of said first frame member, the other ends of said legs being connected to a cylindrical sleeve extending between said first and second legs, said sleeve being oriented to internally receive and guide said flexible connector in a free hanging posture from said first frame member, and said apparatus further comprising a tubular cylinder projecting normally upward from the surface of said platform and dimensioned to be intimately slidingly received within the interior of said cylindrical sleeve connected to said second frame; and said power means connected between said platform on said second frame member is connected at the ends thereof between said platform and said cylindrical sleeve, said power means being actuable to vertically translate said platform with respect to said second frame.

3. An apparatus for launching, retrieving, and servicing a submersible as defined in claim 2, and further comprising:

a slot longitudinally fashioned along said cylindrical sleeve connected to said second frame;

apertured flanges extending along opposite sides of said slot;

an apertured tongue rigidly connected to the exterior surface of said tubular cylinder mounted upon said platform, said tongue being operable to extend through said slot and translate along said flanges for selective registry with said apertures in said flange members; and pinning means operable to extend through aligned apertures of said flanges and said tongue for locking together said cylindrical sleeve and said tubular cylinder.

4. An apparatus for launching, retrieving, and servicing a submersible as defined in claim 3, and further comprising:

first and second opposed, cylindrical sockets mounted on the under surface of said platform;

first and second opposed, conical members mounted over the mouths of said sockets, said conical members being operable to guide into said sockets stanchions projecting from the hull of the submersible; and first and second opposed bearing means for engaging the hull of the submersible and forming, in combination with said first and second cylindrical sockets and the stanchions, a secure four point mating of the submersible and said platform, said bearing means being downwardly extending from said platform and orthogonally offset relative to said first and second conical members.

5. An apparatus for launching, retrieving, and servicing a submersible as defined in claim 1, wherein said power assembly for translating the power cells onto and off said first and second tray comprises:

an endless cable having a loop extending transversely across said plurality of rails and over a selective drive mechanism; and fastening means for selectively connecting said endless cable to the power cells.

6. An apparatus for launching, retrieving, and servicing a submersible as defined in claim 1, wherein said power assembly for selectively translating said first and second trays comprises:

at least one endless, driven chain extending parallel to said plurality of rails and selectively connectable to said first and second trays for translating said trays upon said plurality of rails.

7. An apparatus for launching a submersible into a body of water from the deck of a mother vessel and for retrieving and repositioning the submersible upon the deck of the mother vessel, said apparatus comprising:

a first frame member including first and second coplanar legs each pivotally mounted at one end thereof in a position generally adjacent a peripheral portion of the deck of the mother vessel, said first and second legs being rigidly connected at the other free ends thereof and pivotable in unison to a posture wherein said free ends extend over the deck of the mother vessel or to a posture wherein said free ends extend over the surface of the body of water;

power means connected between said first frame member and the deck of the mother vessel for selectively pivoting said first frame member to a posture wherein said free ends of said legs extend over the deck of the mother vessel or to a posture wherein said free ends of said legs extend over the surface of the body of water;

a second frame member pivotally connected at one end thereof to the free end of said first frame member;

a platform operably positioned adjacent the other end of said second frame member;

power means operably connected between said platform and said second frame member for selectively vertically moving said platform relative to said second frame member;

a winch connected to said floating vessel;

a sheave connected to said free end of said first frame member; and a flexible connector wound at one end upon said winch, passing over said sheave, and extending downwardly through said platform for selective connection to the submersible, the submersible being movable by said flexible connector into engagement with said platform to securely mate the platform to the submersible, said first frame member being then operable to lift and swing the submersible from the deck of the mother vessel or the surface of the body of water with the submersible suspended from said second frame member.

8. An apparatus for launching, retrieving, and repositioning a submersible as defined in claim 7 wherein:

said legs of said first frame member slope mutually inwardly from said pivotally mounted ends and are interconnected at said other ends by a transversely extending member; and said second frame member comprises a generally inverted A-frame having first and second legs pivotally suspended at base portions thereof from said transversely extending member, said legs sloping mutually inwardly and downwardly to a cylindrical sleeve and extending between said first and second legs connected to said A-frame at the apex thereof, said cylinder being oriented to internally receive and guide said flexible connector in a free hanging posture from said first frame member.

9. An apparatus for launching, retrieving, and repositioning a submersible as defined in claim 8 wherein:

said apparatus further comprises a tubular cylinder projecting normally upward from the surface of said platform and dimensioned to be intimately slidingly received within the interior of said cylindrical sleeve connected to said A-frame; and said power means connected between said platform and said second frame member is connected at the ends thereof between said platform and said cylindrical sleeve connected to said A-frame, said power means being actuable to vertically translate said platform, while said platform is guided by the resulting sliding movement of said tubular cylinder within said cylindrical sleeve.

10. An apparatus for launching, retrieving, and repositioning a submersible as defined in claim 9, and further comprising:

a slot longitudinally fashioned along said cylindrical sleeve connected to said A-frame;

apertured flanges extending along opposite sides of said slot;

an apertured tongue rigidly connected to the exterior surface of said tubular cylinder mounted upon said platform, said tongue being operable to extend through said slot and translate along said flanges for selective registry with apertures in said flange members; and pinning means operable to extend through aligned apertures of said flanges and said tongue for locking together said cylindrical sleeve and said tubular cylinder.

11. An apparatus for launching, retrieving, and repositioning a submersible as defined in claim 7, and further comprising:

first and second opposed, cylindrical sockets mounted on the under surface of said platform;

first and second opposed, conical members mounted over the mouths of said sockets, said conical members being operable to guide into said sockets stanchions projecting from the hull of the submersible; and first and second opposed bearing means downwardly extending from said platform and orthogonally offset relative to said first and second conical members and being operable for engaging the hull of the submersible and forming, in combination with said first and second cylindrical sockets and the stanchions, a secure four point mating of the submersible and said platform.

12. An apparatus as described in claim 7 further including means for handling a submersible upon the deck of said mother vessel, said handling means comprising:

a parallel assembly of aligned rollers connected to the deck of the mother vessel;

a frame member mounted between and in a mutually parallel relation with said parallel assembly of aligned rollers;

a rack rigidly connected to one side of the frame member;

a cradle operably resting for translation upon said parallel assembly of aligned rollers and carrying a motor driven pinion gear extending in mating engagement with said rack; and roller guiding assemblies connected between said cradle and said frame member for maintaining said cradle properly positioned upon the parallel assembly of aligned rollers and ensuring proper driving engagement between the pinion and rack;

said cradle being operable to receive said submersible when it is suspended from said second frame member and support said submersible when it is to be suspended from said second frame member.

13. An apparatus for handling a submersible on the deck of a mother vessel as defined in claim 12, and further comprising:

housing means for the submersible including side walls and end walls and a ceiling positioned over and enclosing one end of the parallel assembly of aligned rollers, the other end of said parallel assembly of aligned rollers extending to a position adjacent the periphery of the mother vessel.

14. An apparatus for servicing a submersible on the deck of a mother vessel, said submersible having at least one pod for the storage of dolly mounted power cells for delivering electrical energy to the submersible, said apparatus comprising:

a plurality of mutually parallel rails mounted transversely on the deck of the mother vessel;

a first tray longitudinally extending across said plurality of rails, for lateral translation upon said plurality of rails, said first tray being operable to support a plurality of charged power cells selectively in a position of longitudinal alignment with said at least one pod;

a second tray longitudinally extending across said plurality of rails for lateral translation upon said plurality of rails, said second tray being operable to longitudinally receive a plurality of spent power cells from said at least one pod of the submersible and to translate the plurality of spent cells out of longitudinal alignment with said at least one pod;

a power assembly connected to the mother vessel for longitudinally pulling the power cells onto or off said first or second trays; and a power assembly connected to the mother vessel for selectively translating said trays along said plurality of rails to selectively align said trays with said at least one pod of the submersible.

15. An apparatus for servicing a submersible on the deck of a mother vessel as defined in claim 14, wherein said power assembly for translating the power cells onto and off said first and second trays comprises:

an endless cable having a loop extending transversely across said plurality of rails and over a selective drive mechanism; and fastening means for selectively connecting the dollies to said endless cable.

16. An apparatus for servicing a submersible on the deck of a mother vessel as defined in claim 14, wherein said power assembly for selectively translating said first and second trays comprises:

at least one endless, driven chain extending parallel to said plurality of rails and selectively connectable to said first and second trays for translating said trays upon said plurality of rails.

17. An apparatus for servicing a submersible on the deck of a mother vessel as defined in claim 14, and further comprising:

an enclosure including side walls, end walls and a ceiling positioned over said plurality of rails and connected to the deck of the floating vessel for insulating the plurality of rails and said trays from the ambient environment; and a ventilating assembly connected to the enclosure for selectively circulating ambient air into and out of the interior of said enclosure.

18. A method for retrieving, positioning, and servicing a submersible having at least one pod for the storage of dolly mounted power cells, said method comprising the steps of:

pivoting a first frame member connected to the deck of a mother vessel outwardly over the surface of a body of water;

suspending a platform from said first frame by a second frame pivotally connected to the free end of said first frame;

extending a flexible connector from a winch connected to the mother vessel, over a sheave connected to the free end of the first frame member, and freely downwardly through the platform toward the surface of the body of water;

engaging a catch affixed to the submersible with the free end of the flexible connector;

raising the submersible out of the body of water and mating the platform with the submersible by concurrently taking up said flexible connector on said winch, and lowering said platform relative to said second frame toward and into engagement with said submersible;

pivoting the first frame member toward the deck of the mother vessel until the submersible is freely suspended from the second frame generally above a desired location on the surface of the deck;

paying out said winch to lower said submersible;

positioning the submersible upon a cradle resting at said desired location upon a parallel assembly of aligned rollers;

translating the cradle upon the parallel assembly of aligned rollers away from said first frame to a service location;

aligning in longitudinal alignment with said at least one pod a first longitudinally extending tray carried by a plurality of transverse, mutually parallel rails;

pulling a plurality of dolly carried power cells from the pod and onto the longitudinally extending tray;

laterally translating the tray upon the plurality of rails to a position axially offset relative to said at least one pod;

laterally translating to a position of axial alignment with said at least one pod a second tray carrying a plurality of charged power cells; and moving the plurality of charged power cells into the pod from the second tray for subsequent use in powering the submersible vehicle.

19. The method of retrieving, positioning, and servicing a submersible as defined in claim 18, and further comprising the steps of:

connecting a sea painter to a lead end of the submersible and tensioning the sea painter from a winch connected to the mother vessel to facilitate a desired alignment of the submersible relative to the mother vessel prior to the engagement of said catch by said flexible connector.

20. The method of retrieving, positioning, and servicing a submersible as defined in claim 18, and further comprising the steps of:

mating cylindrical sockets mounted on the under surface of said platform with stanchions projecting from the submersible; and engaging the surface of the submersible with downwardly extending bearing pads to firmly interconnect the platform and the submersible in a four point rigid connection system, said bearing pads being mounted upon the platform and orthogonally offset relative to said cylindrical sockets.

21. The method of retrieving, positioning, and servicing a submersible as defined in claim 18, wherein said step of translating said plurality of power cells into and out of said at least one pod of the submersible comprises the steps of:

connecting a portion of a closed loop cable extending transversely across the plurality of rails to a selective drive mechanism; and selectively driving the cable to insert or withdraw said plurality of dolly mounted power cells into and out of said at least one pod.

22. The method of retrieving, positioning, and servicing a submersible as defined in claim 18, wherein said step of translating said first and second trays includes the step of:

selectively connecting the trays to an endless parallel chain extending generally parallel to said plurality of rails and selectively driven by a power system in either forward or reverse directions to translate the first or second tray selectively into and out of axial alignment with said at least one pod of the submersible.

23. A method for retrieving a submersible from a body of water and positioning the submersible upon the deck of a mother vessel, said method comprising the steps of:

pivoting a first frame member connected to the deck of the mother vessel outwardly over the surface of a body of water;

suspending a platform from said first frame by a second frame pivotally connected to the free end of said first frame;

extending a flexible connector from a winch connected to the mother vessel, over a sheave connected to the free end of the first frame member, and freely downwardly through the platform toward the surface of the body of water;

engaging a catch affixed to the submersible with the free end of the flexible connector;

raising the submersible out of the body of water and mating the platform with the submersible by concurrently taking up said flexible connector on said winch, and lowering said platform relative to said second frame toward and into engagement with said submersible;

pivoting the first frame member toward the deck of the mother vessel until the submersible is freely suspended from the second frame generally above a desired location on the surface of the deck; and paying out said winch to lower said submersible onto the deck of the mother vessel.

24. The method for retrieving a submersible from a body of water and positioning the submersible upon the deck of a mother vessel as defined in claim 23, and further comprising the steps of:

connecting a sea painter to a forward end of the submersible; and tensioning the sea painter from a winch connected to the mother vessel to facilitate a desired alignment of the submersible relative to the mother vessel prior to the engagement of said catch by said flexible connector.

25. The method for retrieving a submersible from a body of water and positioning the submersible upon the deck of the mother vessel as defined in claim 23 wherein said step of mating the platform to the submersible includes the steps of:

mating cylindrical sockets mounted on the under surface of said platform with stanchions projecting from the submersible; and engaging the surface of the submersible with downwardly extending bearing pads to firmly interconnect the platform and the submersible in a four point rigid connection system, said bearing pads being mounted upon the platform and orthogonally offset relative to said cylindrical sockets.

26. A method as described in claim 23 including the step of handling a submersible on the deck of a motor vessel, said step comprising:

said lowering of said submersible, positioning the submersible upon a cradle resting upon a parallel assembly of aligned rollers;

translating the cradle upon the parallel assembly of aligned rollers through actuation of a pinion gear carried by the cradle in mating engagement with a rack connected to the deck of the mother vessel while guiding movement of the cradle through guiding roller assemblies connected between the cradle and a frame positioned on the deck of the mother vessel.

27. A method of servicing a submersible on the deck of a mother vessel, said submersible having at least one pod for the storage of dolly mounted power cells for delivering electrical energy to the submersible, said method comprising the steps of:

aligning in longitudinal alignment with said at least one pod a first longitudinally extending tray carried by a plurality of transverse, mutually parallel rails;

pulling a plurality of dolly mounted power cells from the pod and onto the longitudinally extending tray;

laterally translating the tray upon the plurality of rails to a position axially offset relative to said at least one pod;

laterally translating a position of axial alignment with said at least one pod, a second tray carrying a plurality of charged power cells; and moving the plurality of charged cells into the pod from the second tray for subsequent use in powering the submersible vehicle.

28. The method for servicing a submersible on the deck of a mother vessel as defined in claim 27 wherein said step of translating said plurality of power cells into and out of said at least one pod of the submersible comprises the steps of:

connecting to a selective drive mechanism a portion of a closed loop cable extending transversely across the plurality of rails; and selectively driving the cable to insert or withdraw said plurality of dolly mounted power cells into and out of said at least one pod.

29. The method for servicing a submersible on the deck of a mother vessel as defined in claim 27 wherein said step of translating said first and second trays includes the step of:

selectively connecting the trays to an endless parallel chain extending generally parallel to said plurality of rails and selectively driven by a power system in either forward or reverse directions to translate the first or second tray selectively into and out of axial alignment with said at least one pod of the submersible.

30. The method for servicing a submersible on the deck of a mother vessel as defined in claim 28, and further comprising the steps of:

surrounding said plurality of rails with an enclosure including side walls, end walls and a ceiling to insulate the plurality of rails and said trays from an ambient environment; and ventilating the interior of the enclosure to minimize concentrations of hydrogen during recharging of power cells within the enclosure.

* * * * *